US009376913B2

(12) United States Patent
Rohs et al.

(10) Patent No.: US 9,376,913 B2
(45) Date of Patent: Jun. 28, 2016

(54) AXIAL-PISTON ENGINE WITH A COMPRESSOR STAGE, AND WITH AN ENGINE-OIL CIRCUIT AND A PRESSURE-OIL CIRCUIT AS WELL AS METHOD FOR OPERATION OF SUCH AN AXIAL-PISTON ENGINE

(75) Inventors: Ulrich Rohs, Dueren (DE); Dieter Voigt, Aachen (DE)

(73) Assignee: GETAS Gesellschaft fuer thermodynamische Antriebssysteme mbH, Dueren (DE)

( * ) Notice: Subject to any disclaimer, the term of this patent is extended or adjusted under 35 U.S.C. 154(b) by 1102 days.

(21) Appl. No.: 13/386,595

(22) PCT Filed: Jul. 26, 2010

(86) PCT No.: PCT/DE2010/000877

§ 371 (c)(1),
(2), (4) Date: Jan. 23, 2012

(87) PCT Pub. No.: WO2011/009454

PCT Pub. Date: Jan. 27, 2011

(65) Prior Publication Data

US 2012/0118272 A1 May 17, 2012

(30) Foreign Application Priority Data

Jul. 24, 2009 (DE) ..... 10 2009 034 736

(51) Int. Cl.

| | |
|---|---|
| ***F01M 1/04*** | (2006.01) |
| ***F01B 3/00*** | (2006.01) |
| ***F01M 1/28*** | (2006.01) |

(Continued)

(52) U.S. Cl.

CPC ..... *F01B 3/00* (2013.01); *F01B 3/0005* (2013.01); *F01B 3/0085* (2013.01); *F01M 1/28* (2013.01); *F02B 75/26* (2013.01); *F02G 3/02* (2013.01);

(Continued)

(58) Field of Classification Search

CPC ..... F02G 1/02; F02G 3/02; F02G 2250/03; F01M 1/04; F01M 1/20; F01M 1/28; F01M 2001/123

See application file for complete search history.

(56) References Cited

U.S. PATENT DOCUMENTS

| | | | | |
|---|---|---|---|---|
| 972,504 | A * | 10/1910 | Brown | 60/39.24 |
| 1,097,150 | A | 5/1914 | Vallez | |

(Continued)

FOREIGN PATENT DOCUMENTS

| | | |
|---|---|---|
| EP | 1 035 310 | 9/2000 |
| WO | WO 03/093662 | 11/2003 |

(Continued)

OTHER PUBLICATIONS

International Search Report of PCT/DE2010/000877, date of mailing Feb. 9, 2011.

*Primary Examiner* — Lorne Meade
(74) *Attorney, Agent, or Firm* — Collard & Roe, P.C.

(57) ABSTRACT

The aim of the invention is to improve the efficiency of an axial-piston motor. To this end, the axial-piston motor comprises at least one compressor cylinder, at least one working cylinder and at least one pressure line guiding the compressed fuel from the compressor cylinder to the working cylinder. A working piston comprising a working rod is provided in the working cylinder, and a compressor piston comprising a compressor rod is provided in the compressor cylinder. The axial-piston motor is characterized in that it at least one of the two rods comprises transverse stiffeners.

18 Claims, 9 Drawing Sheets

Figure 1:
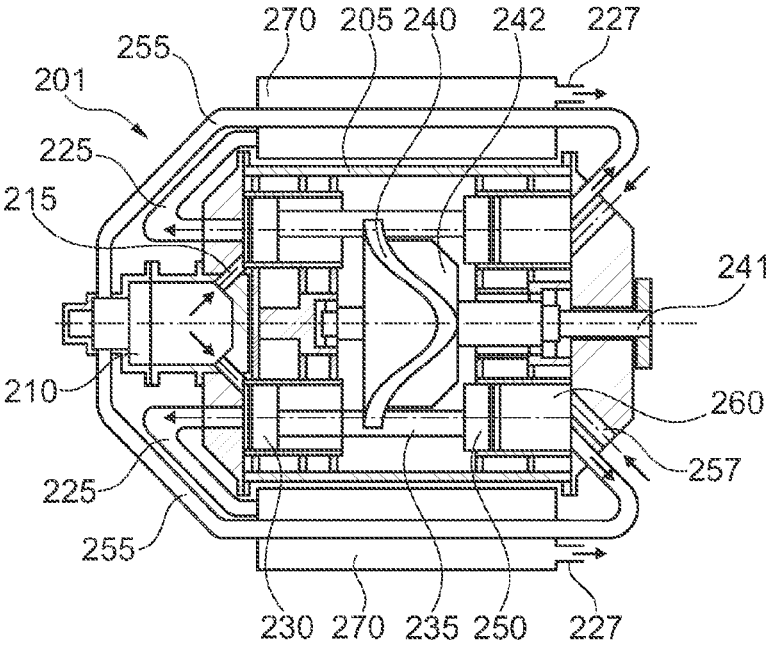

(51) Int. Cl.

| | |
|---|---|
| ***F02B 75/26*** | (2006.01) |
| ***F02G 3/02*** | (2006.01) |
| *F01M 1/20* | (2006.01) |
| *F01M 1/12* | (2006.01) |

(52) U.S. Cl.
CPC .. *F01M 1/04* (2013.01); *F01M 1/20* (2013.01); *F01M 2001/123* (2013.01)

(56) References Cited

U.S. PATENT DOCUMENTS

| | | | | | |
|---|---|---|---|---|---|
| 1,382,485 | A | | 6/1921 | De Lukacsevics | |
| 2,059,802 | A | * | 11/1936 | Logan | 123/46 SC |
| 3,369,530 | A | * | 2/1968 | Campbell | 123/46 R |
| 3,577,729 | A | * | 5/1971 | Warren | 60/39.63 |
| 3,651,641 | A | * | 3/1972 | Ginter | 60/39.26 |
| 3,973,393 | A | * | 8/1976 | Vogelsang | 60/39.63 |
| 4,653,269 | A | * | 3/1987 | Johnson | 60/39.63 |
| 6,092,365 | A | * | 7/2000 | Leidel | 60/39.63 |
| 6,250,264 | B1 | | 6/2001 | Henriksen | |
| 6,412,273 | B1 | | 7/2002 | Rohs | |
| 6,742,503 | B2 | * | 6/2004 | Feucht | 123/446 |
| 2010/0258065 | A1 | * | 10/2010 | Rohs | 123/56.1 |
| 2012/0118249 | A1 | * | 5/2012 | Rohs et al. | 123/56.1 |
| 2012/0118250 | A1 | * | 5/2012 | Rohs et al. | 123/56.1 |
| 2012/0118272 | A1 | * | 5/2012 | Rohs et al. | 123/51 A |

FOREIGN PATENT DOCUMENTS

| | | | | |
|---|---|---|---|---|
| WO | WO 2006/133452 | | 12/2006 | |
| WO | WO 2009/062473 | | 5/2009 | |
| WO | WO2009062473 | * | 5/2009 | F01B 3/0005 |

* cited by examiner

AXIAL-PISTON ENGINE WITH A COMPRESSOR STAGE, AND WITH AN ENGINE-OIL CIRCUIT AND A PRESSURE-OIL CIRCUIT AS WELL AS METHOD FOR OPERATION OF SUCH AN AXIAL-PISTON ENGINE

CROSS REFERENCE TO RELATED APPLICATIONS

This application is the National Stage of PCT/DE2010/000877 filed on Jul. 26, 2010, which claims priority under 35 U.S.C. §119 of German Application No. 10 2009 034 736.4 filed on Jul. 24, 2009. The international application under PCT article 21(2) was not published in English.

The invention relates on the one hand to an axial-piston engine with at least one compressor cylinder, with at least one working cylinder and with at least one pressure line, through which compressed combustion agent is conducted from the compressor cylinder to the working cylinder, wherein a working piston with a working connecting rod is provided in the working cylinder and a compressor piston with a compressor connecting rod is provided in the compressor cylinder.

On the other hand, the invention also relates to an axial-piston engine with at least one compressor cylinder, with at least one working cylinder and with at least one pressure line, through which compressed combustion agent is conducted from the compressor cylinder via a combustion chamber to the working cylinder, wherein the stream of combustion agent from the combustion chamber to the working cylinder is controlled via at least one control piston.

Moreover, the invention relates to an axial-piston engine with at least one compressor cylinder, with at least one working cylinder and with at least one pressure line, through which compressed combustion agent is conducted from the compressor cylinder to the working cylinder, wherein the stream of combustion agent from the combustion chamber to the working cylinder is controlled if necessary via at least one control piston, which is driven by a control drive.

Furthermore, the invention relates to an axial-piston engine with a compressor stage comprising at least one cylinder, with an expander stage comprising at least one cylinder, with at least one component subjected to compression chamber pressure and with an oil circuit for lubrication.

In addition, the invention relates to an axial-piston engine with a compressor stage comprising at least one cylinder, with an expander stage comprising at least one cylinder, with at least one combustion chamber between the compressor stage and the expander stage, and if necessary with at least one heat exchanger, wherein the heat-absorbing part of the heat exchanger is situated between the compressor stage and the combustion chamber and the heat-emitting part of the heat exchanger is situated between the expander stage and an environment.

The invention also relates to an axial-piston engine with a combustion agent supply system and an exhaust gas removal system that are coupled with one another with heat transfer.

Likewise the invention relates to a method for operation of an axial-piston engine with a compressor stage comprising at least one cylinder, with an expander stage comprising at least one cylinder and with at least one combustion chamber between the compressor stage and the expander stage as well as to a method for production of an axial-piston engine that has a compressor stage comprising at least one cylinder and an expander stage comprising at least one cylinder as well as at least one combustion chamber between the compressor stage and the expander stage.

Axial-piston engines are sufficiently known from the state of the art, and are characterized as energy-converting machines, which provide mechanical rotational energy on the output side with the aid of at least one piston, whereby the piston executes a linear oscillatory motion whose alignment is aligned essentially coaxially with the axis of rotation of the rotational energy.

In addition to axial piston engines that are operated, for example, only with compressed air, axial-piston engines to which a combustion agent is supplied are also known. This combustion agent can be made up of a plurality of components, for example a fuel and air, wherein the components are fed, together or separately, to one or more combustion chambers. In the present case, therefore, the term "combustion agent" designates any material that participates in the combustion, or is carried with components that participate in the combustion, and that flows through the axial-piston engine. The combustion agent then includes at least a combustible substance or fuel, wherein the term "fuel" in the present context therefore describes any material that reacts exothermally by way of a chemical reaction or other reaction, in particular by way of a redox reaction. In addition, the combustion agent can also have components such as air, for example, which provide materials for the reaction of the fuel. Likewise the combustion agent can contain further components, such as chemical additives or catalytically acting substances.

In particular, axial-piston engines can also be operated under the principle of internal continuous combustion (icc), according to which combustion agents, i.e., for example fuel and air, are fed continuously to a combustion chamber or to a plurality of combustion chambers.

Moreover, axial-piston engines can work on the one hand with rotating pistons, and correspondingly rotating cylinders, which are moved successively past a combustion chamber. On the other hand, axial-piston engines can have stationary cylinders, wherein the working medium is then successively distributed to the cylinders according to the desired loading sequence.

For example, icc axial-piston engines having stationary cylinders of this sort are known from EP 1 035 310 A2 and from WO 2009/062473 A2, wherein in EP 1 035 310 A2 an axial-piston engine is disclosed in which the supplying of combustion agent and the removal of exhaust gas are coupled with one another with heat exchange.

The axial-piston engines disclosed in EP 1 035 310 A2 and in WO 2009/062473 A2 have in addition a separation between working cylinders and the corresponding working pistons, and compressor cylinders and the corresponding compressor pistons, wherein the compressor cylinders are provided on the side of the axial-piston engine facing away from the working cylinders. In this respect, a compressor side and a working side can be assigned to such axial-piston engines.

It is understood that that the terms "working cylinder," "working piston" and "working side" are used synonymously with the terms "expansion cylinder," "expansion piston" and "expansion side" or "expander cylinder," "expander piston" and "expander side," as well as synonymously with the terms "expansion stage" or "expander stage," wherein an "expander stage" or "expansion stage" designates the totality of all "expansion cylinders" or "expander cylinders" located therein.

The task of the present invention is to improve the efficiency of an axial-piston engine.

This task is accomplished by an axial-piston engine with at least one compressor cylinder, with at least one working cylinder and with at least one pressure line, through which compressed combustion agent is conducted from the compressor cylinder to the working cylinder, wherein a working piston with a working connecting rod is provided in the working cylinder and a compressor piston with a compressor connecting rod is provided in the compressor cylinder, in which at least one of the two connecting rods has transverse stiffeners.

If such transverse stiffeners are provided at least on one of the two connecting rods, the connecting rod can be formed on the whole with substantially less mass, whereby this connecting rod can be advantageously configured with lighter weight. In this respect, less mass must be moved or accelerated for the connecting rod equipped with such transverse stiffeners, whereby the present axial-piston engine can be operated more effectively. Hereby the overall efficiency of the axial-piston engine is advantageously improved.

Transverse stiffeners can be used, especially in lightweight construction, in order to be able to make components sufficiently stiff and stable despite reduction or savings of material. The term "transverse" is used in the present case as soon as a main extent of the stiffener has a component perpendicular to the main extent direction for example of the connecting rod or perpendicular to the main axis—seen in axial direction—of the axial-piston engine.

The task of the invention is also accomplished in particular by an axial-piston engine with at least one compressor cylinder, with at least one working cylinder and with at least one pressure line, through which compressed combustion agent is conducted from the compressor cylinder to the working cylinder, wherein a working piston with a working connecting rod is provided in the working cylinder and a compressor piston with a compressor connecting rod is provided in the compressor cylinder, and the working piston has transverse stiffeners.

The working piston can also be made with substantially more lightweight structure by the provision of suitable transverse stiffeners, so that less mass on the axial-piston engine must be moved with the working piston itself, whereby the efficiency of the axial-piston engine can be further improved.

In this connection, the task of the invention is also accomplished by an axial-piston engine of the class in question in which, cumulatively or alternatively, the compressor piston has transverse stiffeners. The axial-piston engine also has to perform less internal work when the compressor piston can be provided with a smaller mass by virtue of transverse stiffeners.

In order to accomplish the task of the invention, an axial-piston engine with at least one compressor cylinder, with at least one working cylinder and with at least one pressure line, through which compressed combustion agent is conducted from the compressor cylinder to the working cylinder is further proposed, wherein a working piston with a working connecting rod is provided in the working cylinder and a compressor piston with a compressor connecting rod is provided in the compressor cylinder, and the axial-piston engine is characterized specifically in that at least one of the two connecting rods is of aluminum.

By virtue of the use of aluminum or of an alloy thereof, it is possible to reduce the mass of moving components advantageously, whereby the axial-piston engine can additionally work more effectively. In this respect, an increase of the efficiency of the axial-piston engine is also achieved. It is understood that any other lightweight material can also be advantageously used instead of aluminum, as long as it withstands the operating temperatures or other boundary conditions. If necessary, suitable measures such as for example thermal insulation systems at suitable places can also be employed, in order to permit the use of lightweight materials.

It is understood that further, especially moving components of the axial-piston engine can also be made of a lightweight material, provided then they still always have sufficient strength and/or stiffness.

In this respect, the pistons of the axial-piston engine can also be formed by means of aluminum or an alloy thereof, except for their hot regions that can come directly into contact with hot media. The term "hot region" in the present connection describes in particular regions of a piston, facing combustion agents, that could be subjected to critical thermal stress.

In view of this, the task of the present invention is also accomplished by an axial-piston engine with at least one compressor cylinder, with at least one working cylinder and with at least one pressure line, through which compressed combustion agent is conducted from the compressor cylinder to the working cylinder, wherein a working piston with a working connecting rod is provided in the working cylinder and a compressor piston with a compressor connecting rod is provided in the compressor cylinder and wherein the axial-piston engine is characterized by a working piston of aluminum, which has burning protection, preferably of iron, on the working cylinder side.

Hereby a very lightweight construction of the working piston—except for its hot region—can be guaranteed, whereby the efficiency of the axial-piston engine can be further improved.

If necessary, this burning protection can also be realized with other materials, for example with a ceramic coating. Working pistons of a ceramic material would also be conceivable in this case.

Independently of the other features of the invention, the task of the present invention is also accomplished by an axial-piston engine of the class in question, which is characterized by a compressor piston of aluminum, since hereby the lightweight construction of the axial-piston engine described above can be advantageously further improved accordingly.

If necessary, burning protection must also be provided on the compressor cylinder side of the compressor cylinder, if work with hot combustion agents is already being performed on the compressor cylinder. Here also the burning protection can consist of a more heat-resistant material. For example, the burning protection is made from iron or from a ceramic, wherein compressor pistons of a ceramic material could certainly also find use in the present case.

Thus, with regard to the working pistons and compressor pistons described and used here, the piston bottom can advantageously consist of iron or steel and the piston stem advantageously of aluminum or of an alloy thereof.

Such pistons of reduced weight or optimized weight are not known from the relevant state of the art mentioned at the beginning, so that the present advantageous further development cannot be obviously inferred from this relevant state of the art, even though it was the task of the inventions of the state of the art mentioned at the beginning to improve axial-piston engines further as regards their efficiency.

An alternative accomplishment of the task of the present invention proposes an axial-piston engine with at least one compressor cylinder, with at least one working cylinder and with at least one pressure line, through which compressed combustion agent is conducted from the compressor cylinder via a combustion chamber to the working cylinder, wherein a working piston with a working connecting rod is provided in the working cylinder and a compressor piston with a compressor connecting rod is provided in the compressor cylinder and wherein both the working connecting rod and the compressor connecting rod and also the working and compressor pistons are made of steel.

If both pistons are made of steel, on the one hand the pistons are particularly temperature-resistant, and on the other hand it is not necessary to allow for different material properties in a single component. In addition, the one-piece construction of the pistons is more cost-effective, wherein the mass of the pistons can be reduced to a minimum by virtue of the higher strength of the steel and by further constructional measures, for example the transverse stiffeners mentioned above. Hereby weight disadvantages compared with an aluminum piston can also be put into perspective. In particular, it is also possible to configure the respective connecting rod likewise of steel, so that the entire arrangement of working piston and working connecting rod as well as of compressor connecting rod and compressor piston can be formed of identical material and if necessary even of one piece. The former facilitates as the case may be connection of the respective assemblies, since different material properties are not present and cannot impair the connection, while the latter by its nature does not even permit any connection problems at all to occur.

Since the forces acting on the compressor piston side are usually different from those on the working piston side, especially the connecting rod of the compressor piston can be configured with reduced weight compared with the connecting rod of the working piston. In this respect, the task of the invention is also accomplished by an axial-piston engine with at least one compressor cylinder, with at least one working cylinder and with at least one pressure line, through which compressed combustion agent is conducted from the compressor cylinder to the working cylinder, wherein a working piston with a working connecting rod is provided in the working cylinder and a compressor piston with a compressor connecting rod is provided in the compressor cylinder and wherein the compressor connecting rod is made lighter than the working connecting rod. In particular, the working piston can also be made differently from the compressor piston in this case. For example, the compressor piston is made lighter, since it is not exposed to as large forces with regard to a working medium of the axial-piston engine. Thus the axial-piston engine can be adapted very precisely to its specific loads and optimized accordingly.

Furthermore, the task of the invention is also accomplished by an axial-piston engine of the class in question, in which an output bearing, which transfers energy from at least one of the connecting rods to an output shaft, is formed with thinner structure on the compressor connecting rod side than on the working connecting rod side. Since the forces—usually smaller forces—acting on the respective connecting rod on the compressor piston side are different from those acting on the working piston side, the connecting rod can advantageously be made lighter with regard to its weight on the compressor side. However, this may also depend in particular on the material used or even be a question of the construction or of the mass ratios. If the working connecting rod and compressor connecting rod are formed in one piece, they can be produced very cost-effectively. It is advantageous when the working connecting rod and compressor connecting rod are formed coaxially with one another. Hereby particularly favorable load conditions can be created, especially also on a housing of the axial-piston engine.

The present task is also accomplished independently of the other features of the invention by an axial-piston engine with at least one compressor cylinder, with at least one working cylinder and with at least one pressure line, through which compressed combustion agent is conducted from the compressor cylinder via a combustion chamber to the working cylinder, wherein the stream of combustion agent from the combustion chamber to the working cylinder is controlled via at least one control piston and wherein the control piston is formed from iron or steel on the combustion chamber side. Since the control piston also comes into contact with very hot working media or combustion agents of the axial-piston engine, it is advantageous when at least these regions of the control piston are configured to be heat-resistant. In this respect, any other heat-resistant material, such as ceramic for example, can likewise be employed instead of iron or steel. Advantageously, the control piston is otherwise formed from aluminum or an alloy thereof, so that the control piston is particularly light and thereby extremely short reaction times can be achieved.

Alternatively to this, the entire control piston can be made of iron or steel, since the control pistons are usually small and thus have little mass. This is a good solution in particular when extremely short control times do not play a very important role or—precisely because of the light weight of the control pistons—can be achieved in any case.

In order to accomplish the task of the invention further, an axial-piston engine with at least one compression cylinder, with at least one working cylinder and with at least one pressure line, through which compressed combustion agent is conducted from the compressor cylinder to the working cylinder, wherein the stream of combustion agent from the combustion chamber to the working cylinder is controlled via at least one control piston, is proposed alternatively or cumulatively, which is characterized in that at least one surface of the control piston on the combustion chamber side is reflective. By such reflectiveness it is advantageously possible to reduce the thermal load of the respective assembly, especially by reflection of the heat-loading radiation.

Alternatively or cumulatively to this, the task of the invention can be accomplished accordingly by an axial-piston engine with at least one compression cylinder, with at least one working cylinder and with at least one pressure line, through which compressed combustion agent is conducted from the compressor cylinder to the working cylinder, wherein the stream of combustion agent from the combustion chamber to the working cylinder is controlled via at least one control piston, which is characterized in that the combustion chamber has a combustion chamber floor of reflective metal.

The reflectiveness of a metal surface imparts the further advantage that the flow of heat in the wall developing due to the large temperature difference between the burned combustion agent and the metal surface can be reduced, at least for the flow of heat in the wall caused by heat radiation. A large proportion of efficiency losses in a combustion engine occurs due to this cited flow of heat in the wall, which is why an efficient possibility of increasing the thermodynamic efficiency of the axial-piston engine by the proposed accomplishments of the invention is achieved by reducing the flow of heat in the wall.

It is understood that, on the one hand, even nonmetallic surfaces can impart an advantage in thermodynamic efficiency by reflectiveness and that, on the other hand, this advantage in thermodynamic efficiency can be achieved cumulatively or alternatively by the fact that each component of the axial-piston engine coming into contact with combustion agent is reflective, provided the temperature of the combustion agent is higher than the wall temperature.

Furthermore, it is understood that any other surface coating capable of increasing the spectral reflectivity of the component surfaces can be used. Obviously any surface coating is further conceivable that alternatively or cumulatively to this decreases the heat transmission coefficient of a component surface, in order to decrease the proportion of thermodynamic losses by convection.

Furthermore, in order to accomplish the task of the invention, alternatively or cumulatively, an axial-piston engine with a compressor stage comprising at least one cylinder, with an expander stage comprising at least one cylinder, with at least one combustion chamber between the compressor stage and the expander stage, with at least one component subjected to combustion chamber pressure and with an oil circuit for lubrication is proposed, wherein the oil circuit has an engine-oil circuit and a pressure-oil circuit with a pressure level different from the engine-oil circuit. Hereby the advantage is implemented that, in a respective oil circuit with a different pressure level, the oil pump of that circuit, for example a pressure-oil pump of the pressure-oil circuit, has to apply only the backpressure needed for delivery of the oil, and the higher pressure that may be necessary in this circuit for other reasons for achievement of a pressure exceeding that for conveying the oil does not have to be applied by the pressure-oil pump. By the fact that the pressure-oil circuit can have components that work against a combustion chamber pressure present in the combustion chamber, it is correspondingly advantageous when the pressure level of the pressure-oil circuit corresponds to the combustion chamber pressure.

Alternatively or cumulatively to this, it can also be of advantage that the pressure level of the pressure-oil circuit corresponds to a compressor pressure. By a pressure level of the pressure-oil circuit corresponding to the combustion chamber pressure or to the compressor pressure, a gas force acting on a component subjected to combustion chamber pressure, for example on a control piston, can be largely compensated pneumatically. The task of further improving an axial-piston engine with respect to its efficiency is accomplished to the extent that a piston work acting on the control piston is minimized and thus the work or power output at the axial-piston engine is maximized for equal consumption of combustible substance.

In this connection, it must be pointed out that the phrase "the pressure level corresponds to a pressure" also tolerantly permits a pressure difference up to 40% between the pressure level and the pressure, whether it be the compressor pressure or the combustion chamber pressure. Preferably, however, a pressure difference of at most 7 bar is to be encompassed by the phrase "the pressure level corresponds to a pressure". Such pressure differences can still be absorbed without too great efficiency losses of seals, which also withstand higher temperatures.

In order not to impede this efficiency-improving advantage for variable power output of the axial-piston engine, it is further proposed that the pressure-oil circuit have a pressure level higher than 20 bar at a full load of the axial-piston engine. Cumulatively or alternatively, it is proposed that the pressure-oil circuit have a pressure level between 5 bar and 20 bar during a partial load of the axial-piston engine. This ensures a balanced pressure ratio for a large part of all operating situations, by which the efficiency is optimized. Alternatively or cumulatively to this, it is further proposed that the pressure-oil circuit have a pressure level below 5 bar during idling of the axial-piston engine and/or during standstill of the axial-piston engine. Particularly in these operating states, this permits a small load of the corresponding seals, so that even any leakage streams in particular, which could be active over a longer time period, have no substantial disturbing influences. In a load-dependent and unstationary operation of the axial-piston engine, it is possible by this measure to implement in particular the advantage that a compensation of the combustion chamber pressure at a component subjected to combustion chamber pressure always corresponds to the combustion chamber pressure or to the load point of the axial-piston engine. An efficiency optimized under various operating conditions is hereby assured by the fact that the gas force needed for the compensation of the combustion chamber pressure is made available as needed at the components subjected to combustion chamber pressure. A gas force that always turns out to be higher leads to overcompensation of the combustion chamber pressure, whereby a compressor power that is not favorable to efficiency would be called upon in turn for generation of the compensating pressure at the compressor stage.

In this case "idling" means the operating state in which the indicated power of the axial-piston engine corresponds in essence to the friction loss of the axial-piston engine, i.e., the effective power is zero.

The task of the invention, to improve an axial-piston engine with respect to its efficiency by separation of the oil circuit into an engine-oil circuit and a pressure-oil circuit, is supplementally accomplished in particular in that the engine-oil circuit has an engine-oil sump and an engine-oil pump and the pressure-oil circuit has a pressure-oil sump and a pressure-oil pump. This has the efficiency-increasing advantage that the engine-oil pump and the pressure-oil pump can make an independent oil volume flow available for the engine-oil circuit and the pressure-oil circuit, and thus the power demand of the engine-oil pump and of the pressure-oil pump corresponds to the requirements of the engine-oil circuit and of the pressure-oil circuit.

In order to assure the wetting of the components subjected to combustion chamber pressure, such as the control piston, for example, and other components in interaction with the control piston, it is further proposed that the pressure-oil sump have means for recording an oil level. Advantageously these means for recording an oil level are characterized in that the oil level of the pressure-oil sump determined by the means for recording an oil level is a minimum and/or a maximum oil level. This advantage contributes to the fact that not only is deficient lubrication prevented operationally reliably but also that overfilling of the pressure-oil circuit and accompanying effects such as oil foaming, oil ejection or an otherwise undesired oil escape from the pressure-oil circuit is prevented.

Furthermore it is proposed that at least one control chamber be a component of the pressure-oil circuit. The advantage of this arrangement is derived from the fact that the control chamber, which is formed on the side of the control piston facing away from the combustion chamber, can compensate for the combustion chamber pressure acting on the control piston, because of the pressure level of the pressure-oil circuit corresponding to the combustion chamber pressure level.

By "control chamber" in this case a corresponding cavity is described, which is situated on a side of the control piston or of the control pistons facing away from the combustion chamber. The side facing away from the combustion chamber is defined in addition to this by the direction of movement of the control piston. Thus the side facing away from the combustion chamber corresponds to the side of the control piston on which an applied gas pressure, in its resultant, opposes the combustion chamber pressure acting on the control piston. Further assembles that interact with the control piston or control pistons, such as, for example, cam plates with controlling effect or bearing arrangements, can also be provided in the control chamber. In this respect, the pressure-oil circuit of the oil-circuit may also contain parts of the control piston or control pistons, wherein the oil circulating for lubrication of the control piston can flow into this control chamber after wetting of the friction pairs situated on the control piston and from here can be collected in an oil sump.

In order to implement the efficiency-optimizing advantage of the compensation of a combustion chamber pressure acting on various components, it is further proposed that the pressure-oil circuit be connected via a charging line with at least one cylinder of the compressor stage. The use of such a charging line imparts the advantage that a pressure level of magnitude similar to that in the combustion chamber can always be provided in the pressure-oil circuit operationally safely and simply according to the demand. Expediently and advantageously, a pressure buildup controlled or regulated via this charging line in dependence of the operating paint is made available.

In order to do justice to the requirements of varying load points of the axial-piston engine, it is proposed that a charging valve be situated between at least one cylinder of the compressor stage and the pressure-oil circuit, in order to make available a pressure buildup controlled or regulated in dependence on the operating point. This charging valve can be provided in particular in the charging line already described above.

The charging valve preferably does justice to the regulation-related complexity by the fact that the charging valve is designed to be switchable, especially by the fact that the charging valve is designed to be switchable via the compressor pressure. To this end the charging valve can be operatively connected with the compressor stage and can have a control device with means for switching.

In one suitable embodiment, the charging valve can be, for example, an electrically or electronically actuated or else even a pneumatically actuated valve. Thus the charging valve can be actuated indirectly by a control instrument or else even directly by the compressor pressure present at the valve. If the compressor pressure exceeds a specified value, the charging valve opens and the compressor stage is connected with the pressure-oil circuit, whereby charging of the pressure-oil circuit with compressed air or another medium present in the compressor stage takes place.

Corresponding to the load points present during operation of the axial-piston engine, the charging valve is advantageously characterized in that the charging valve switches at a charging pressure of 5 bar, preferably at 10 bar, most preferably at 30 bar. This has the advantage that a pressure that is necessary for compensation of a combustion chamber pressure acting on a component or that very largely corresponds to this can be made available in the pressure-oil circuit. Furthermore, escape of pressure from the pressure-oil circuit is effectively prevented by the charging valve described above, provided the compressor pressure drops below a pressure level that is present in the pressure-oil circuit. Advantageously a charging valve can be designed as a pneumatic, pressure-controlled multi-way valve, so that active control of the charging valve is possible.

Furthermore, it is also conceivable that the charging valve is a check valve, especially a pressure-controlled check valve. This permits switching of the charging valve that is structurally particularly simple, without necessitating further measures.

The use of a pressure supplied by a compressor stage of the axial-piston engine, wherein air supplied for application of this pressure or a supplied combustion agent usually has a temperature level higher than the environmental conditions during compression from environmental conditions, can have the consequence that a pressure drop after a throttling point, such as a valve represents, or cooling at a wall of the charging line, can have the consequence of condensation of a fluid.

As a further configuration of the pressure-oil circuit, it is therefore proposed that an oil trap be situated between the charging valve and the pressure-oil circuit. Since oil collected in this oil trap is already at a high pressure level, it is further proposed that a drain of the oil trap be connected with the pressure-oil sump. Furthermore, it is proposed that a water trap be situated between the charging valve and the pressure-oil circuit. Hereby it may be possible to collect water vapor present in the compressed air already and effectively before introduction of this compressed air, so that condensation of the water vapor in the pressure-oil circuit is prevented and consequently the useful life of the axial-piston engine is not limited by occurring corrosion. For the case of return flow from the pressure-oil line to the compressor stage, a loss of oil from the pressure-oil circuit can also be effectively prevented if, as proposed, an oil trap is used and a drain of the oil trap feeds the collected oil to the pressure-oil circuit again. By means of the oil trap, it is also possible in particular to prevent damage to the axial-piston engine, as could be caused in the compressor stage by self-ignition of oil-containing air.

Use, favoring efficiency, of a pressure level in the pressure-oil circuit that is higher than in the engine-oil circuit may lead to a greater oil leakage from the pressure-oil circuit into the engine-oil circuit because of the existing pressure gradient. In order to maintain the efficiency-increasing advantage of a pressure-oil circuit continuously during the entire operation of the axial-piston engine, it is therefore expedient that an equalizing valve be disposed between the pressure-oil sump and the pressure-oil pump as well as between the engine-oil sump or the engine-oil pump and the pressure-oil pump. This has the advantage that a drop below a minimum necessary oil level in the pressure-oil sump can be prevented by the fact that the pressure-oil pump draws oil from the engine-oil sump until the oil level of the pressure-oil sump reaches a maximum. This efficiency-preserving configuration of the oil circuit is further implemented by the fact that the equalizing valve is operatively connected to the means for recording an oil level.

Furthermore, it is proposed that the equalizing valve be operatively connected with a control device. Such a control device can be, for example, a control instrument of the axial-piston engine, in which performance characteristics or algorithms are resident, according to which connection of the pressure-oil circuit with the engine-oil circuit is also to be established in order to achieve equalization of the oil level in the pressure-oil circuit. Consequently the equalizing valve can be connected directly with the means for recording an oil level or else indirectly via a control device with the means for recording an oil level.

It is also conceivable that the control device activates the equalizing valve not only via the oil level in the pressure-oil circuit but also via the temperature or another characterizing variable, such as, for example, an emergency running signal or a maintenance signal, in order, for example, to achieve exchange of the oil present in the pressure-oil circuit.

The use of a higher pressure level in the pressure-oil circuit than in the engine-oil circuit is energetically particularly advantageous when the equalizing valve, preferably in a first operating state, connects the pressure-oil sump with the pressure-oil pump and, in a second operating state, connects the engine-oil sump or the engine-oil pump with the pressure-oil pump. This has the advantage of assuring the efficiency by use of the pressure-oil circuit to the effect that the engine-oil circuit and the pressure-oil circuit are connected only at small pressure differences between these two partial circuits, so that the power consumption of the pressure-oil pump does not lead to efficiency losses due to overcoming a large pressure difference.

For an efficiency-maintaining configuration of the equalizing valve, it is proposed cumulatively to this that the first operating state correspond to the partial load and/or to the full load of the axial-piston engine and the second operating state correspond to the idling and/or standstill state of the axial-piston engine. This configuration of the equalizing valve ensures that the equalizing valve is switched only at small pressure differences between the engine-oil circuit and the pressure-oil circuit, in order to prevent, effectively, return flow of the oil from the pressure-oil circuit into the engine-oil circuit because of a negative pressure gradient. Emptying of the pressure-oil circuit could impair the efficiency of the axial-piston engine significantly, possibly due to deficient lubrication.

Alternatively or cumulatively, it is therefore further proposed that a return-flow valve designed as a check valve be situated between the engine-oil sump and the equalizing valve or between the engine-oil pump and the equalizing valve. By means of this return-flow valve, inadvertent emptying of the pressure-oil circuit can be further prevented advantageously during a malfunction of the equalizing valve.

In particular, it is accordingly proposed that the return-flow valve have a flow direction from the engine-oil circuit to the pressure-oil circuit.

The safeguarding function of the check valve is advantageously implemented in this arrangement by the fact that hereby further filling of the pressure-oil circuit at a positive pressure gradient is possible, whereas emptying at a negative pressure gradient is suppressed.

For the implementation of an efficiency-improved axial-piston engine, a method for operation of an axial-piston engine with a compressor stage comprising at least one cylinder, with an expander stage comprising at least one cylinder and with at least one combustion chamber between the compressor stage and the expander stage, wherein a stream of combustion agent, under combustion chamber pressure, from the combustion chamber to the cylinder of the expander stage is controlled via at least one control piston and the axial-piston engine has at least one oil circuit for lubrication, is additionally proposed accordingly, which is characterized in that the oil circuit is split into an engine-oil circuit and into a pressure-oil circuit and components of the axial-piston engine subjected to combustion chamber pressure are lubricated by the pressure-oil circuit.

In addition to this, it is proposed that the combustion chamber pressure acting on the control piston be compensated by a pressure level present in a control chamber and corresponding to the combustion chamber pressure.

This proposed method for an axial-piston engine again contributes to an efficiency improvement of the axial-piston engine, in that, on the one hand, the two partial circuits of the oil circuit, considered independently, each work at a minimum necessary pressure level and thus the power consumption of the oil pumps present in these partial circuits is adapted to the demand, minimum and therefore optimized with respect to efficiency. On the other hand, by the compensation of a combustion chamber pressure on the components subjected to combustion chamber pressure, especially on the control piston subjected to combustion chamber pressure, piston work on the control piston, not conducive to the efficiency of the work cycle, is prevented or minimized, so that the thermodynamic efficiency of the axial-piston engine is maximized.

Advantageously, the pressure level in the control chamber corresponding to the combustion chamber pressure can be supplied by the compressor stage. This imparts the advantage that an additional aggregate or an additional assembly is not necessary for generation of a corresponding pressure level, and furthermore this has the advantage that the pressure or the pressure level supplied by the compressor stage also lies on an order of magnitude that corresponds to the combustion chamber pressure to be compensated.

Preferably, in the case of a drop below a minimum oil level in a pressure-oil sump, the pressure-oil circuit is filled with oil from the engine-oil circuit. This has the advantage that oil for lubrication of the components subjected to combustion chamber pressure is always adequately available, by the fact that oil emerging from the pressure-oil circuit due to the elevated pressure is replaced by oil from the engine-oil circuit. To this end the pressure-oil circuit can be connected with the engine-oil circuit, especially during idling and/or during standstill of the axial-piston engine, since then the pressure differences are relatively small. A large pressure difference to be overcome between the pressure-oil circuit and the engine-oil circuit can be advantageously circumvented by this proposed method, in that the removal of oil from the engine-oil circuit takes place in particular when the pressure difference between the engine-oil circuit and the pressure-oil circuit is minimum, so that the power consumption of the two pressure-oil pumps caused by this pressure difference is minimum and consequently the overall efficiency of the axial-piston engine is maximized.

Alternatively or supplementally to the last-mentioned method, the pressure-oil circuit can be connected with the engine-oil circuit at a pressure difference smaller than 5 bar between the pressure-oil circuit and the engine-oil circuit. This procedure offers the advantage that the pressure-oil circuit can be filled with oil from the engine-oil circuit when a pressure difference between the engine-oil circuit and the pressure-oil circuit has assumed a value, independently of the speed of revolution of the axial-piston engine, at which overcoming of the pressure difference necessary for filling the pressure-oil circuit requires a minimum power consumption of the oil pump used for this. Thus the pressure-oil circuit can be filled operationally reliably with favorable efficiencies even during operation of the axial-piston engine.

The task of the present invention is accomplished, cumulatively or alternatively to the other features of the present invention, by an axial-piston engine with a combustion agent supply system and an exhaust gas removal system that are coupled with one another with heat transfer, which axial-piston engine is characterized by at least one heat exchanger insulation system. In this way it is possible to ensure that as much thermal energy as possible remains in the axial-piston engine and is transferred back to the combustion agent by way of the heat exchangers. In this connection, it is understood that the heat exchanger insulation does not necessarily have to completely surround the heat exchangers, since some waste heat can possibly also be used advantageously at a different location in the axial-piston engine. However, the heat exchanger insulation should be provided in particular toward the outside.

Preferably, the heat exchanger insulation is designed such that it allows a maximum temperature gradient of 400° C., especially of at least 380° C., between the heat exchanger and the environment of the axial-piston engine. In particular, as the transfer of heat progresses, i.e., toward the compressor side, the temperature gradient can then quickly become significantly smaller. Cumulatively or alternatively to this, the heat exchanger insulation can preferably be designed so that the exterior temperature of the axial-piston engine in the area of the heat exchanger insulation does not exceed 500° C. or 480° C. In this way it is ensured that the quantity of energy lost through heat radiation and heat conduction is reduced to a minimum, since the losses rise disproportionately at even higher temperatures or temperature gradients. Furthermore, the maximum temperature or maximum temperature gradient occurs only at a small location, since otherwise the temperature of the heat exchanger decreases more and more toward the compressor side.

Preferably the heat exchanger insulation includes at least one component made of a material that differs from the heat exchanger. This material can then be designed optimally for its task as insulation, and can comprise for example asbestos, asbestos substitute, water or air, wherein the heat transfer insulation must have a housing in the case of fluid insulation materials, in particular in order to minimize heat removal through material movement, while in the case of solid insulation materials a housing can be provided for stabilization or as protection. In particular, the housing can be formed from the same material as the jacket material of the heat exchanger.

Independently of this, the task of the invention is also accomplished by an axial-piston engine that is characterized by at least two heat exchangers. In this case the axial-piston engine essentially comprises a combustion agent supply system and an exhaust gas removal system that are coupled with one another with heat transfer. Especially in the case of a plurality of outlet valves per working cylinder, exhaust gases can be removed more rapidly from the respective working cylinder when, for example, a first heat exchanger is connected after and assigned to first outlet valves and a second heat exchanger is connected after and assigned to second outlet valves. Although two heat exchangers initially lead to a greater expense and more complex flow conditions, which therefore actually reduce the efficiency, the use of two heat exchangers makes possible significantly shorter paths to the heat exchanger and a more favorable energy arrangement of the latter. This surprisingly allows the efficiency of the axial-piston engine to be increased significantly.

This is true in particular for axial-piston engines with stationary cylinders in which the pistons work in each instance, in contrast to axial-piston engines in which the cylinders and therefore also the pistons likewise rotate around the axis of rotation, since the latter arrangement needs only one exhaust gas line, alongside which the cylinders are guided.

Preferably, the heat exchangers are positioned essentially axially, wherein the term "axially" in the present context designates a direction parallel to the main axis of rotation of the axial-piston engine, or parallel to the axis of rotation of the rotational energy. This allows an especially compact and therefore energy-saving design, which is also true in particular if only one heat exchanger, especially if an insulated heat exchanger is used.

If the axial-piston engine has at least four pistons, it is advantageous if the exhaust gases from at least two adjacent pistons are conducted into one heat exchanger, in each instance. In this way, the paths between piston and heat exchanger for the exhaust gases can be minimized, so that losses in the form of waste heat that cannot be recovered by way of the heat exchangers can be reduced to a minimum. The latter can even be achieved if the exhaust gases from three adjacent pistons are conducted into one common heat exchanger, in each instance.

On the other hand, it is also conceivable that the axial-piston engine comprises at least two pistons, wherein the exhaust gases from each piston are conducted into a heat exchanger of their own. In this respect, it can be advantageous—depending on the concrete implementation of the present invention—if a heat exchanger is provided for each piston. It is true that this leads to an increased construction expense; but on the other hand, the heat exchangers can each be smaller, and therefore possibly of simpler construction, whereby the axial-piston engine as a whole is built more compactly and thus is subject to smaller losses. In particular with this configuration, but also if a heat exchanger is provided for every two pistons, the respective heat exchanger can—if necessary—be integrated into the spandrel between two pistons, whereby the entire axial-piston engine can be designed correspondingly compactly.

According to another aspect of the invention, an axial-piston engine with a compressor stage comprising at least one cylinder, with an expander stage comprising at least one cylinder, and with at least one heat exchanger, wherein the heat-absorbing part of the heat exchanger is situated between the compressor stage and the combustion chamber and the heat-emitting part of the heat exchanger is situated between the expander stage and an environment is proposed, which is characterized in that the heat-absorbing and/or the heat-emitting part of the heat exchanger has, downstream and/or upstream, means for applying at least one fluid.

The application of a fluid into the stream of combustion agent can contribute to an increase in the transfer capacity of the heat exchanger, for example since the specific heat capacity of the stream of combustion agent can be adjusted to the specific heat capacity of the exhaust gas stream, through the application of a suitable fluid, or else can be increased beyond the specific heat capacity of the exhaust gas stream. The transfer of heat from the exhaust gas stream to the combustion agent stream influenced thereby, for example advantageously, contributes to the ability of a higher quantity of heat to be coupled into the combustion agent stream and thus into the working cycle while the construction size of the heat exchanger remains the same, whereby the thermodynamic efficiency can be increased. Alternatively or cumulatively, a fluid can also be applied to the exhaust gas stream. The applied fluid in this case can be for example a necessary aid for a downline exhaust gas post-treatment, which can be mixed ideally with the exhaust gas stream by a turbulent flow formed in the heat exchanger, so that a downline exhaust gas post-treatment system can thus be operated with maximum efficiency.

"Downstream" designates in this case the side of the heat exchanger from which the respective fluid emerges, or that part of the exhaust gas line or of the pipework carrying the combustion agent into which the fluid enters after leaving the heat exchanger.

By analogy to this, "upstream" designates the side of the heat exchanger into which the respective fluid enters, or that part of the exhaust gas line or of the pipework carrying the combustion agent from which the fluid enters into the heat exchanger.

In this respect, it does not matter whether the application of the fluid takes place immediately in the near spatial vicinity of the heat exchanger, or whether the application of the fluid takes place at a greater spatial distance.

Water and/or combustible substance for example can be applied appropriately as fluid. This has the advantage that the combustion agent stream has on the one hand the previously described advantages of an increased specific heat capacity through the application of water and/or combustible substance, and on the other hand that the mixture can be prepared already in the heat exchanger or ahead of the combustion chamber and the combustion can take place in the combustion chamber with a combustion air ratio of the greatest possible local homogeneity. This also has in particular the advantage that the combustion behavior is marked only very slightly or not at all with efficiency-degrading, incomplete combustion.

For another configuration of an axial-piston engine, it is proposed that a water trap be situated in the heat-emitting part of the heat exchanger or downstream from the heat-emitting part of the heat exchanger. Because of the reduced temperature existing at the heat exchanger, vaporous water could condense out and damage the subsequent exhaust gas line by corrosion. Damage to the exhaust gas line can be reduced advantageously through this measure.

In addition, a method for operation of an axial-piston engine with a compressor stage comprising at least one cylinder, with an expander stage comprising at least one cylinder, with at least one combustion chamber between the compressor stage and the expander stage and with at least one heat exchanger, wherein the heat-absorbing part of the heat exchanger is situated between the compressor stage and the combustion chamber and the heat-emitting part of the heat exchanger is situated between the expander stage and an environment, is proposed, in which at least one fluid is applied to the combustion agent stream flowing through the heat exchanger and/or to the exhaust gas stream flowing through the heat exchanger. It is hereby possible—as already shown above—to improve the efficiency-enhancing transfer of heat from an exhaust gas stream being conducted into an environment into a combustion agent stream, by increasing the specific heat capacity of the combustion agent stream through the application of a fluid, and thus also increasing the flow of heat to the combustion agent stream. The regenerative coupling of an energy stream into the working cycle of the axial-piston engine in this case can in turn bring about an increase in efficiency, in particular an increase in the thermodynamic efficiency, when the process is carried out appropriately.

Advantageously, the axial-piston engine is operated in such a way that water and/or combustible substance are applied. The result of this procedure is that the efficiency in turn, in particular the efficiency of the combustion process, can be increased through ideal mixing in the heat exchanger and ahead of the combustion chamber.

Combustible substance can likewise be applied to the exhaust gas flow, if this is expedient for example for an exhaust gas aftertreatment, so that the exhaust gas temperature can be further increased in the heat exchanger or after the heat exchanger. If necessary, postcombustion, which aftertreats the exhaust gas in an advantageous manner and minimizes pollutants, can also be carried out in this way. Heat released in the heat-emitting part of the heat exchanger could thus also be used indirectly for further warming of the combustion agent stream, so that the efficiency of the axial-piston engine is hardly influenced negatively thereby.

In order to further implement this advantage, a method for operation of an axial-piston engine is further proposed which is characterized in that the fluid is applied downstream and/or upstream from the heat exchanger.

Cumulatively or alternatively to this, separated water can be applied back into the combustion agent stream and/or the exhaust gas stream. In the most favorable case, a closed water circuit is thereby realized, to which no additional water needs to be supplied from outside. Thus an additional advantage arises from the fact that a vehicle equipped with an axial-piston engine of this construction does not have to be refilled with water, in particular not with distilled water.

Advantageously, the application of water and/or combustible substance is stopped at a defined point in time before the axial-piston engine comes to a stop, and the axial-piston engine is operated until it comes to a stop without application of water and/or fuel. The water, possibly harmful for an exhaust gas line, which can be deposited in the exhaust gas line, in particular when the latter cools, can be avoided by this method. Advantageously, any water is also removed from the axial-piston engine itself before the axial-piston engine comes to a stop, so that damage to components of the axial-piston engine by water or water vapor, especially during the stoppage, is not promoted.

Furthermore, the task of the invention is accomplished by an axial-piston engine with at least one compressor cylinder, with at least one working cylinder and with at least one pressure line through which compressed combustion agent is conducted from the compressor cylinder via a combustion chamber to the working cylinder, wherein the stream of combustion agent from the combustion chamber to the working cylinder is controlled via at least one control piston, which is driven by a control drive, and wherein the axial-piston engine is characterized in that the control piston, in addition to the force applied by the control drive, is subjected on its side facing away from the combustion chamber to a compensating force directed counter to the combustion chamber pressure.

Advantageously, by means of such an additional compression force, sealing relative to the control piston can be substantially improved in the combustion chamber, wherein merely pure simple oil scraping ideally suffices for sealing, so that sealing in this respect as known from International Patent Application WO 2009/062473 A2 is substantially simplified. At this place it must be pointed out that especially the control drive can be diversely designed, for example as a hydraulic, electrical, magnetic or mechanical control drive. It is particularly advantageous when the force applied by the control drive is different from the compensating force directed, according to the invention, counter to the combustion chamber pressure.

In general the entire control drive can be built substantially more compactly, since in essence it has to absorb only guide forces. Necessary forces exceeding this can, according to the invention, by applied by the compensating force, so that the control drive is not loaded or is loaded to only a negligible extent by forces for sealing relative to the control piston. The control pistons are also subjected to correspondingly less load and can be designed correspondingly lighter and simpler. Since only a single oil scraper is needed, the load on the control drive is also decreased hereby.

It is understood that such a compensating force can be applied in various ways by construction. To this end a preferred alternative embodiment provides that the compensating force is applied mechanically, for example via springs, since a mechanical arrangement can be structurally implemented very simply in the axial-piston engine.

Alternatively to this, it is advantageous when the compensating force is applied hydraulically, for example via oil pressure. Such an oil pressure can be supplied, for example, via an oil pump, especially also via a separate oil pump. Certainly the necessary oil pressure can be chosen in such a way that an oil pressure normally present in the axial-piston engine suffices for generation of the compensating force and can be used for this. Advantageous, however, is a separate oil pump and a separate oil circuit, which works starting from another pressure in the axial-piston engine, especially against the compressor pressure, for example, so that this oil pump has to supply only low power. This accomplishment can be employed supplementally if necessary to the oil circuit operated at increased pressure described above.

With regard to a further alternative embodiment, it is provided that the compensating force is applied pneumatically, especially via the compressor pressure. This pneumatic variant has in particular the advantage that the pressure for generating the compensating force is present in any case in the axial-piston engine and in addition corresponds advantageously to approximately the combustion chamber pressure, since the actual work for generation of the pressure is already performed in the working piston. In this respect, only slight sealing, which needs only a small pressure difference for sealing, need be provided. Supplementary to this, an oil pump can produce a corresponding oil film, wherein this then advantageously guides the oil in a separate circuit, wherewith this oil pump is exposed to only a particularly low backpressure, as was already explained above. In this respect, the oil pump then does not have to apply pump work against the compressor pressure.

Advantageously, as already explained above, the pneumatically generated compensating force can be generated by means of a provided combustion agent pressure of ca. 30 bar. Hereby especially the control chamber can be advantageously sealed so that—as already indicated above—only oil scraping is necessary for sealing.

In this respect, a further accomplishment of the present task provides an axial-piston engine with at least one compressor cylinder, with at least one working cylinder and with at least one pressure line, through which compressed combustion agent is conducted from the compressor cylinder to the working cylinder, wherein the stream of combustion agent from the combustion chamber to the working cylinder is controlled via at least one control piston, which is driven by a control drive, and wherein the axial-piston engine is characterized in that the control piston is disposed in a pressure space, for example the control chamber already explained in detail above.

On the basis of the fact that the control piston is inherently situated in a pressure space or in the control chamber, advantageously no complex sealing is necessary, so that work can be done with little losses from the axial-piston engine, whereby the efficiency of the axial-piston engine in turn can be improved. From the state of the art, it has previously been known only that the combustion chamber side but not the control piston is provided in a pressure space.

In this connection, the term "pressure space" denotes any enclosed space of the axial-piston engine that has a distinct overpressure relative to the environment, preferably at least 10 bar., which is true in particular under certain circumstances for the control chamber explained above.

Furthermore, the task of the invention is also accomplished by an axial-piston engine with at least one compressor cylinder, with at least one working cylinder and with at least one pressure line, through which compressed combustion agent is conducted from the compressor cylinder to the working cylinder, wherein the stream of combustion agent from the combustion chamber to the working cylinder is controlled via at least one control piston, which is driven by a control drive, and wherein the axial-piston engine is characterized in particular in that the control drive comprises a control shaft, which drives the control piston and cooperates with a shaft seal, which is subjected to compressor pressure on one side.

If the shaft seal is subjected to compressor pressure on one side, no further sealing is necessary in the ideal case, and the axial-piston engine can advantageously be operated with a smaller loss. The shaft seal then serves preferably as the seal for a pressure space of the axial-piston engine, which in particular can have the compressor pressure.

With an appropriately configured shaft seal, however, it is also possible to work with atmospheric pressure or with an other engine pressure that is lower than the compressor pressure.

According to a further aspect of the invention, an axial-piston engine with a compressor stage comprising at least one cylinder, with an expander stage comprising at least one cylinder and with at least one combustion chamber between the compressor stage and the expander stage is proposed, which is characterized in that the compressor stage has a stroke volume different from the expander stage.

In particular, it is proposed cumulatively hereto that the stroke volume of the compressor stage be smaller than the stroke volume of the expander stage.

Furthermore, a method for operation of an axial-piston engine with a compressor stage comprising at least one cylinder, with an expander stage comprising at least one cylinder and with at least one combustion chamber between the compressor stage and the expander stage is proposed, which is characterized in that a combustion agent or a burned combustion agent present as exhaust gas is expanded during expansion in the expander stage with a greater pressure ratio than a pressure ratio existing during compression in the compressor stage.

The thermodynamic efficiency of the axial-piston engine can be advantageously maximized particularly advantageously by these measures in each instance, since, in contrast to the state of the art heretofore, as in WO 2009/062473, for example, the theoretical thermodynamic potential of a work cycle implemented in an axial-piston engine can be utilized to the maximum by the prolonged expansion permitted hereby. In an engine drawing from the environment and exhausting into this same environment, the thermodynamic efficiency due to this measure reaches its maximum efficiency in this respect when the expansion takes place up to the pressure of the environment.

Therefore a method for operation of an axial-piston engine is further proposed, by means of which the combustion agent is expanded in the expander stage approximately up to the pressure of an environment.

By "approximately", an environmental pressure raised at the maximum by the amount of the friction loss of the axial combustion engine is meant. Compared with expansion up to the amount of the friction loss, expansion up to the exact environmental pressure does not bring about any substantial advantage in efficiency at a friction loss different from 0 bar. The amount of the friction loss can be interpreted as a pressure that is constant on average acting on the piston, wherein the piston is to be considered as free of forces when the cylinder internal pressure acting on the top side of the piston is equal to the environmental pressure acting on the bottom side of the piston plus the friction loss. Therefore a more favorable overall efficiency of a combustion engine is already achieved upon reaching a relative expansion pressure that lies at the level of the friction loss.

Advantageously, an axial-piston engine for implementation of this advantage can be further designed in such a way that an individual stroke volume of at least one cylinder of the compressor stage is smaller than the individual stroke volume of at least one cylinder of the expander stage. In particular, it is conceivable, by means of a large individual stroke volume of the cylinders of the expander stage, in the case that the numbers of cylinders of the expander stage and of the compressor stage are to remain identical, to favor the thermodynamic efficiency by exerting a favorable influence on the surface-to-volume ratio, whereby smaller losses of heat in the wall are achieved in the expander stage. In this case it is understood that this configuration is advantageous for an axial-piston engine with a compressor stage comprising at least one cylinder, with an expander stage comprising at least one cylinder, with at least one combustion chamber between the compressor stage and the expander stage, even independently of the other features of the present invention.

Alternatively or cumulatively, it is also proposed that the number of cylinders of the compressor stage be equal to or smaller than the number of cylinders of the expander stage.

In addition to the above advantages, the mechanical efficiency of the axial-piston engine and thus also the overall efficiency of the axial-piston engine can be maximized by the choice of a suitable number of cylinders, especially a decreased number of cylinders, with identical individual stroke volume of a cylinder of the expander and compressor stages, in that at least one cylinder of the compressor stage is omitted for achievement of a prolonged expansion and thus the friction loss of the omitted cylinder likewise no longer has to be applied. Some imbalances that could be caused by such an asymmetry of the arrangement of pistons or cylinders can be tolerated under certain circumstances or prevented by supplementary measures.

For accomplishment of the task set in the introduction, an axial-piston engine with a compressor stage comprising at least one cylinder, with an expander stage comprising at least one cylinder, with at least one combustion chamber between the compressor stage and the expander stage is further proposed, which is characterized in that at least one cylinder has at least one gas-exchange valve of a light metal. Light metal, especially during use of moving components, reduces the inertia of the components consisting of this light metal and, because of its low density, can reduce the friction loss of the axial-piston engine to the effect that the control drive of the gas-exchange valves is designed to correspond to the lower inertial forces. The reduction of the friction loss by use of components of light metal leads in turn to a smaller overall loss of the axial-piston engine and simultaneously to an increase of the overall efficiency.

Cumulatively hereto, it is proposed that the axial-piston engine be characterized in that the light metal is aluminum or an aluminum alloy, especially dural. Aluminum, especially a hard or very hard aluminum alloy, offers special advantages for a configuration of a gas-exchange valve, since in this case not only the weight of a gas-exchange valve via the density of the material but also the strength of a gas-exchange valve can be increased or maintained at a high level. Obviously it is also conceivable that the material titanium or magnesium or an alloy of aluminum, titanium and/or magnesium can be used instead of aluminum or an aluminum alloy. In particular, a correspondingly lightweight gas-exchange valve can follow load changes correspondingly faster than can be done, already on the basis of the greater inertia, by a heavy gas-exchange valve.

In particular, the gas-exchange valve can be an inlet valve. The advantage of a lightweight gas-exchange valve and of an associated lower mean friction pressure or a smaller friction loss of the axial-piston engine can be implemented especially during use of an inlet valve of a light material, since low temperatures, at a sufficient distance from the melting temperature of aluminum or aluminum alloys, are present at this place of the axial-piston engine.

According to a further aspect of the invention, an axial-piston engine with at least one compressor cylinder, with at least one working cylinder and with at least one pressure line, through which compressed combustion agent is conducted from the compressor cylinder via a combustion chamber to the working cylinder, wherein the stream of combustion agent from the combustion chamber to the working cylinder is controlled via at least one control piston, which is driven by a control drive, is proposed for accomplishment of the task presented in the introduction, which is characterized in that the control piston has a cavity filled with metal that is liquid at operating temperature of the axial-piston engine or a cavity filled with metal alloy that is liquid at operating temperature of the axial-piston engine. The use of a metal alloy or of a metal that is liquid at operating temperature can be used for intensive cooling of the control piston, whereby the control piston can be advantageously used with sufficient useful life and strength even at higher temperatures.

It is proposed cumulatively to this that the metal or the metal alloy contain at least sodium. With its very low melting temperature and its good manipulability in the combustion engine, sodium has the advantage that it can be used in hot components. It is understood that any metal from the alkali group of the Periodic System can also be used, provided the melting temperature of the metal lies below the operating temperature of the axial-piston engine. Furthermore, it is understood that the materials mercury, gallium, indium, tin, lead or alloys of these materials as well as other liquid metals can also be used for this purpose.

The task explained initially is also accomplished—especially in distinction relative to WO 2009/062473 A2—by an axial-piston engine with a compressor stage comprising at least one cylinder, with an expander stage comprising at least one cylinder, with at least one combustion chamber between the compressor stage and the expander stage, with at least one control piston as well as a channel between the combustion chamber and the expander stage, wherein the control piston and the channel have a flow cross section with a main flow direction released by movement of the control piston and the control piston has a guide face parallel to the main flow direction and/or an impact face perpendicular to the main flow direction, and wherein the control piston as well as the channel has a flow cross section released by movement of the control piston and the movement of the control piston takes place along a longitudinal axis of the control piston and the control piston has a guide face and/or an impact face at an acute angle to the longitudinal axis of the control piston.

Usually a charge exchange between two components of a combustion engine encumbered with volume is connected through a throttling point, with flow losses. Such a throttling point, which in the present situation is formed by the channel and the control piston, causes a loss of efficiency due to these flow losses. The fluidically favorable configuration of this channel and/or of the control piston therefore brings about an increase in efficiency.

Accordingly, a guide face of the control piston aligned parallel to the main flow direction has the advantage of preventing flow losses and maximizing the efficiency. In particular, when the flow is structured specifically such that it does not take place perpendicular to the longitudinal axis of the control piston, it is possible, by a guide face aligned at an acute angle to the longitudinal axis of the control piston, for the guide face to be at a favorable angle relative to a flow streaming over this guide face. Advantageously, the efficiency of the axial-piston engine is also increased by this measure, in that the flow losses at the guide face or at the control piston are minimized.

In the present case, "main flow direction" means the flow direction of the combustion agent through the channel, which is measurable and also graphically representable for laminar and even for turbulent flow of the combustion agent. The feature "parallel" therefore relates to this main flow direction and is to be understood in the mathematically geometric sense, wherein a guide face of a control piston parallel to the main flow direction absolutely does not absorb any momentum due to the flow of the combustible material or absolutely does not change the momentum of the flow.

Provided the control piston has reached a position in which the control piston closes the released flow cross section, this impact face formed perpendicular to the main flow direction is advantageously positioned with a minimum surface relative to the combustion chamber, so that combustion agent present in this combustion chamber also brings about a minimum heat flow into the control piston. Thus, by this impact face with minimum size relative to the main flow direction, the smallest possible heat losses at the wall are also achieved, whereby the thermodynamic efficiency of the axial-piston engine is maximized in turn.

Similarly to the guide face already described above, the impact face can in turn be situated by means of the acute angle and placed in such a way in the flow of combustion agent that the impact face, provided the flow does not take place perpendicular to the control piston or to the longitudinal axis of the control piston, has a minimum surface relative to the flow. An impact face designed to be minimum in turn imparts the advantage that heat losses at the wall are reduced on the one hand and that unfavorable deflections of the flow, with formation of vortices, are minimized and the thermodynamic efficiency of the axial-piston engine is correspondingly maximized.

The guide face and/or the impact face can be a planar face, a spherical face, a cylindrical face or a conical face. A planar configuration of the guide face and/or of the impact face imparts the advantage that, on the one hand, the control piston can be produced particularly simply and cost effectively and that, on the other hand, a sealing face cooperating with the guide face can also be designed with simple construction and a maximum sealing effect takes place at this guide face. A spherical configuration of the guide face and/or of the impact face further imparts the advantage that this guide face is geometrically adapted particularly well to the channel following it, provided the channel also has a circular or else even elliptical cross section. Thus no undesired breakaway flows or turbulences develop at the transition from the control piston or from the guide face of the control piston to the channel. Likewise, a cylindrical guide face and/or impact face can implement the advantage that a flow with prevention of flow breakaways or turbulences can take place at a transition between the control piston and the channel or else even a transition between the control piston and the combustion chamber. Alternatively, a conical face on the guide face and/or on the impact face can also be advantageous, provided the channel following the control piston has a cross section that is variable over, the length of the channel. Should the channel be formed as a diffusor or as a nozzle, the flow can again take place without breakaway or turbulences, because of a conically designed guide face on the control piston. It is understood that every measure explained above has efficiency-maximizing effect in itself, even independently of the other measures.

The axial-piston engine can have a guide-face sealing face between the combustion chamber and the expander stage, wherein the guide-face sealing face is formed parallel to the guide face and cooperates with the guide face at a top dead point of the control piston. Since the control piston also has a sealing effect at its top dead point, the guide-face sealing face is advantageously formed such that it cooperates over a large area with the guide face at the top dead point of the control piston and thus a sealing effect takes place. The maximum sealing effect of the guide-face sealing face is then obtained when every point of the guide-face sealing face has the same distance to the guide face, preferably zero distance to the guide face. A guide-face sealing face formed complementarily to the guide face satisfies these requirements regardless of which geometry the guide face has.

Cumulatively hereto, it is proposed that the guide-face sealing face merge on the channel side into a surface perpendicular to the longitudinal axis of the control piston. In a very simple design, the transition of the guide-face sealing face into a surface standing perpendicular to the longitudinal axis of the control piston can also consist of a sharp bend, whereby the flow streaming over the guide-face sealing face can break away at this sharp bend or at this transition, so that the flow of combustion agent can pass over with the least possible flow losses into the channel following the control piston.

Alternatively or cumulatively to the above features, it is proposed that the axial-piston engine have a stem-sealing face between the combustion chamber and the expander stage, wherein the stem-sealing face is formed parallel to the longitudinal axis of the control piston and cooperates with a surface of a stem of the control piston. Provided the control piston reaches its top dead point, not only does the control piston have the task of sealing relative to the combustion chamber but sealing also takes place advantageously relative to the expander stage, as takes place by the interaction of the stem of the control piston and the corresponding stem-sealing face. Hereby losses due to leakage via the control piston are further reduced, whereby the overall efficiency of the axial-piston engine can in turn be maximized.

Furthermore, it is proposed that the guide face, the impact face, the guide-face sealing face, the stem-sealing face and/or the surface of the stem of the control piston have a reflective surface. Since each of these surfaces can be in contact with combustion agent, a flow of heat in the wall and therefore an efficiency loss can also take place via each of these faces. A reflective surface therefore prevents unnecessary losses due to heat radiation and therefore imparts the advantage of increasing the thermodynamic efficiency of the axial-piston engine correspondingly.

The task mentioned at the beginning is also accomplished by a method for production of a heat exchanger of an axial-piston engine which has a compressor stage comprising at least one cylinder, an expander stage comprising at least one cylinder and at least one combustion chamber between the compressor stage and the expander stage, wherein the heat-absorbing part of the heat exchanger is situated between the compressor stage and the combustion chamber and the heat-emitting part of the heat exchanger is situated between the expander stage and an environment, wherein the heat exchanger includes at least one pipe wall dividing the heat-emitting part from the heat-absorbing part of the heat exchanger to separate two streams of material, and wherein the production method is characterized in that the pipe is situated in at least one matrix consisting of a material corresponding to the pipe, and is connected by material bonding and/or by friction to this matrix.

The use of a heat exchanger in an axial-piston engine described above can lead to disadvantages through the occurrence of especially high temperature differences between the input and between the output of the heat exchanger on the one hand and between the heat-absorbing and heat-emitting part of the heat exchanger on the other hand, due to damage to the material that limits the service life. In order to counter thermal stresses that result from this and losses of combustion agent or exhaust gas that occur due to damage, with appropriate configuration, according to the proposal described above, a heat exchanger can be produced advantageously almost exclusively of only one material at its points that are subject to a critical stress. Even if the latter is not the case, material stresses are advantageously reduced through the solution described above.

It is understood that a solder or other means used for fixing or mounting the heat exchanger can consist of a different material, especially when regions with a high thermal stress or with a high seal tightness requirement are not in question.

The use of two or more materials with the same thermal expansion coefficients is also conceivable, whereby the occurrence of thermal stresses in the material can be countered in similar manner.

To construct a material and/or frictional connection between the pipe and the matrix, a method for production of a heat exchanger is further proposed, which is characterized in that the material connection between the pipe and the matrix is made by welding or soldering. The seal tightness of a heat exchanger is ensured in a simple manner and especially advantageously by a method of this sort. In this case it is again also possible to use a material corresponding to the pipe or to the matrix as the welding or soldering material.

Alternatively or cumulatively to this, the frictional bond between the pipe and the matrix can also be accomplished by shrinking. This in turn has the advantage that thermal stresses between the pipe and the matrix can be prevented, since the use of a material that is different from the material of the pipe or of the matrix, for example, in a materially bonded connection, is avoided. The corresponding connection can then also be made rapidly and operationally reliably.

According to a further aspect of the invention, an axial-piston engine with a compressor stage comprising at least one cylinder, with an expander stage comprising at least one cylinder, with at least one combustion chamber between the compressor stage and the expander stage is proposed, wherein the axial-piston engine includes a gas exchange valve that oscillates and releases a flow cross section, and the gas exchange valve closes this cross section by means of a spring force of the valve spring acting on the gas-exchange exchange valve, and wherein the axial-piston engine is characterized in that the gas exchange valve has an impact spring. Gas exchange valves that are self-actuated, i.e., not cam-actuated, which open at an applied pressure difference, can be accelerated so strongly, when the pressure difference present causes a very large opening force, that either the valve spring of the gas exchange valve becomes fully compressed or the valve spring plate or else even a comparable bracing ring strikes another component. Such an impermissible and undesired contact between two components can very quickly lead to destruction of these components. In order to prevent slamming of the valve spring plate effectively, a further spring designed as an impact spring is therefore advantageously provided, which dissipates excess kinetic energy of the gas exchange valve and brakes the gas exchange valve to a standstill.

In particular, the impact spring can have a shorter spring length than a spring length of the valve spring. Provided the two springs, the valve spring and the impact spring, have a common bearing face, the impact spring is advantageously designed such that the spring length of the installed valve spring is always shorter than the spring length of the impact spring, so that the valve spring, upon opening of the gas exchange valve, initially applies exclusively the forces necessary to close the gas exchange valve and, after the maximum provided valve stroke has been reached, the impact spring comes into contact with the gas exchange valve, in order immediately to prevent further opening of the gas exchange valve.

Cumulatively to this, the spring length of the impact spring can correspond to the spring length of the valve spring decreased by a valve stroke of the gas exchange valve. Expediently and advantageously in this case, the circumstance is used that the difference of the spring lengths of the two springs corresponds precisely to the amount of the valve stroke.

In this case the term "valve stroke" denotes the stroke of the gas exchange valve from which the flow cross section released by the gas exchange valve reaches approximately a maximum. A plate valve commonly used in engine construction usually has a linearly increasing geometric flow cross section at small degree of opening, which then merges into a line with constant value upon further opening of the valve. The maximum geometric opening cross section is usually reached when the valve stroke reaches 25% of the internal valve seat diameter. The internal valve seat diameter is the smallest diameter present at the valve seat.

The term "spring length" in this case denotes the maximum possible length of the impact spring or of the valve spring in the installed state. Thus the spring length of the impact spring corresponds exactly to the spring length in the untensioned state and the spring length of the valve spring exactly to the length that the valve spring has in the installed state with the gas exchange valve closed.

Alternatively or cumulatively to this, it is further proposed that the spring length of the impact spring correspond to a height of a valve guide increased by a spring travel of the impact spring. This has the advantage that a valve guide, but also any other fixed component that can come into contact with a moving component of the valve control system, absolutely does not come into contact with a moving component of the valve control system, since the impact spring, even upon reaching the provided spring travel, is absolutely not compressed so much that contact occurs.

The term "spring travel" in this case denotes the spring length minus the length of the spring that exists at maximum load. The maximum load in turn is defined via the computed design of the valve drive, including a factor of safety. Thus the spring travel is exactly the length by which the spring is compressed when the maximum load occurring in operation of the axial-piston engine or the maximum valve stroke provided in operation of the axial-piston engine occurs during abnormal load. The maximum valve stroke in this context denotes the valve stroke defined above plus a stroke of the gas exchange valve at which contact between a moving component and a fixed component just occurs.

Any other component that can come into contact with moving parts of the valve drive can take the place of a valve guide.

Furthermore, upon reaching the spring travel of the impact spring, the impact spring may have a potential energy that corresponds to the maximum operationally caused kinetic energy of the gas exchange valve upon release of the flow cross section. Precisely upon satisfaction of this physical or kinetic condition, braking of the gas exchange valve is achieved precisely when contact between two components is just not made. As explained above, the maximum operationally caused kinetic energy is the kinetic energy of the gas exchange valve that can occur for the computed design of the valve drive, including a factor of safety. The maximum operationally caused kinetic energy is caused by the maximum pressures or pressure differences present at the gas exchange valve, whereby the gas exchange valve is accelerated on the basis of its mass and after decay of this acceleration acquires a maximum speed of motion. Excess kinetic energy stored in the gas exchange valve is absorbed via the impact spring, so that the impact spring becomes compressed and has potential energy. Upon reaching the spring travel of the impact spring or upon maximum provided compression of the impact spring, dissipation of the kinetic energy of the gas exchange valve or of the valve group to the amount of zero is advantageous, so that contact between two components just does not occur. The term "maximum operationally caused kinetic energy" therefore also encompasses the kinetic energies of all components moved with the gas exchange valve, such as, for example, the valve keys, valve spring plates or valve springs.

Additional advantages, objectives and properties of the present invention will be explained on the basis of the following description of the enclosed drawing, in which examples of various axial-piston engines and their assemblies are depicted.

The figures show the following.

Figure 2:
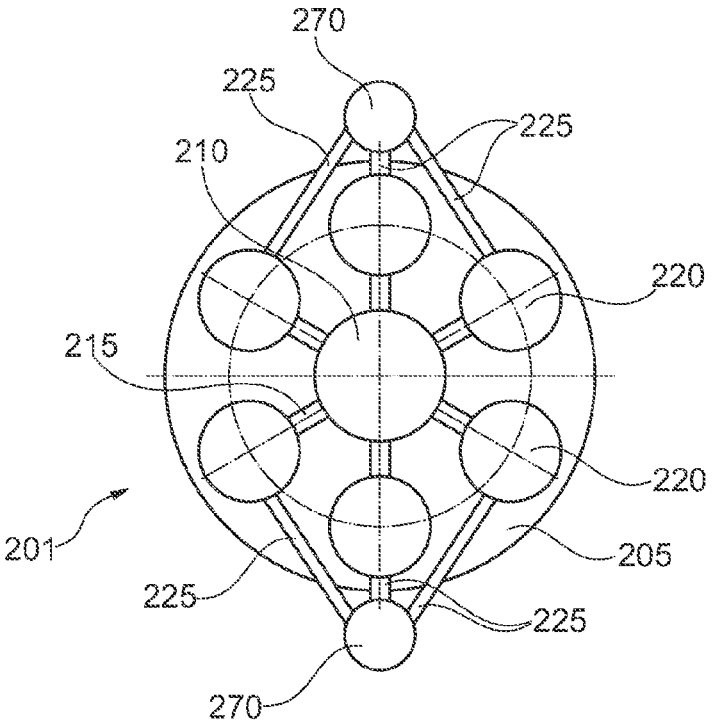
Figure 3:
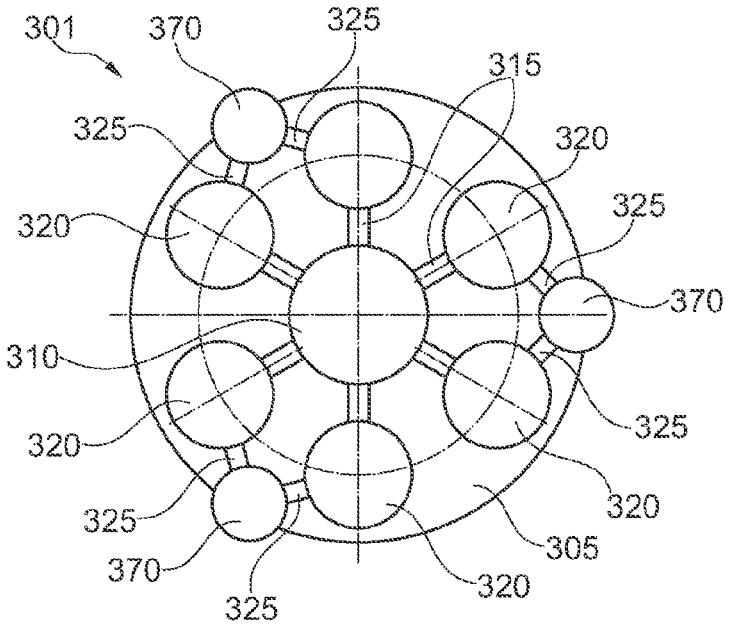
Figure 4:
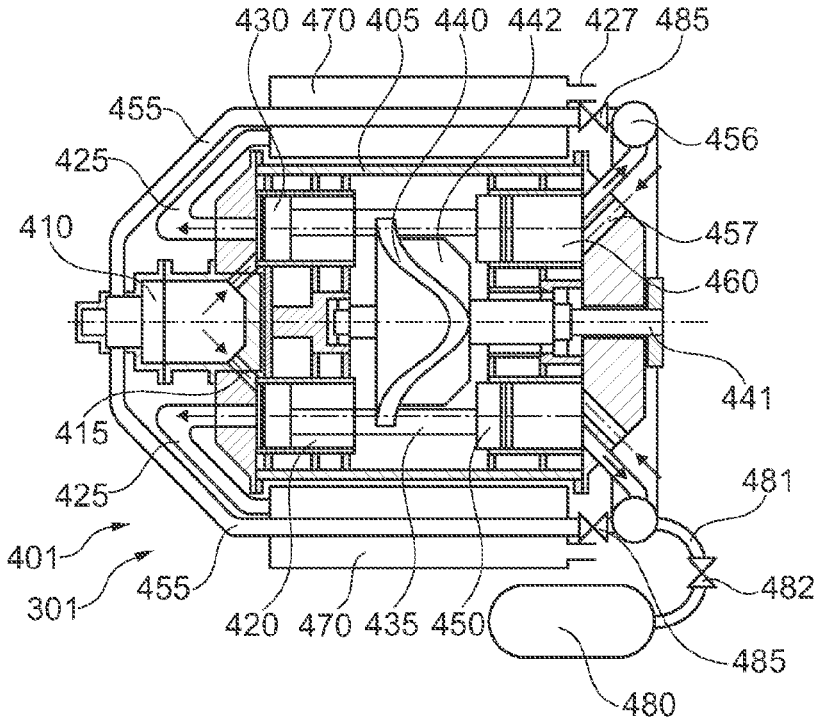
Figure 5:
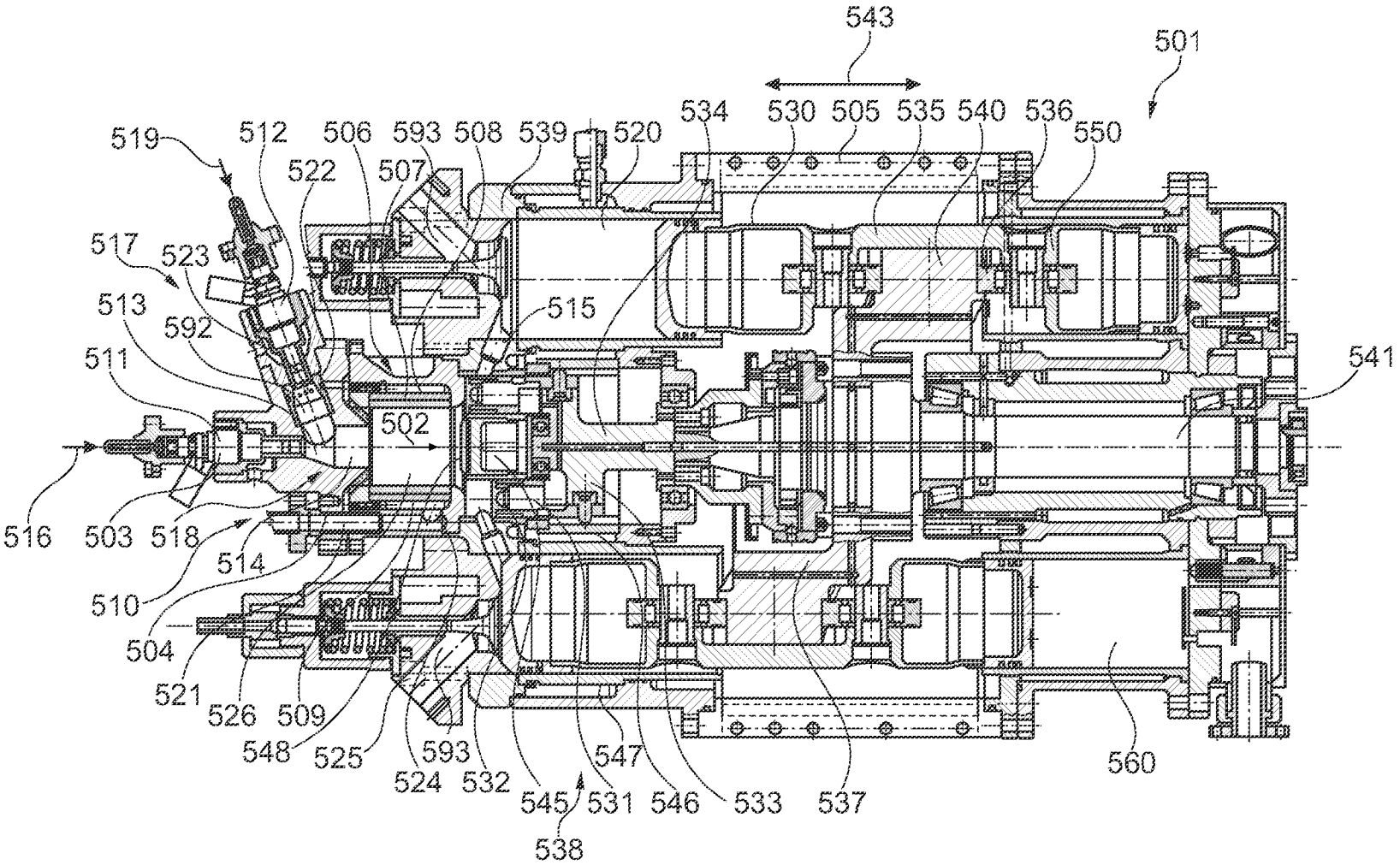
Figure 6:
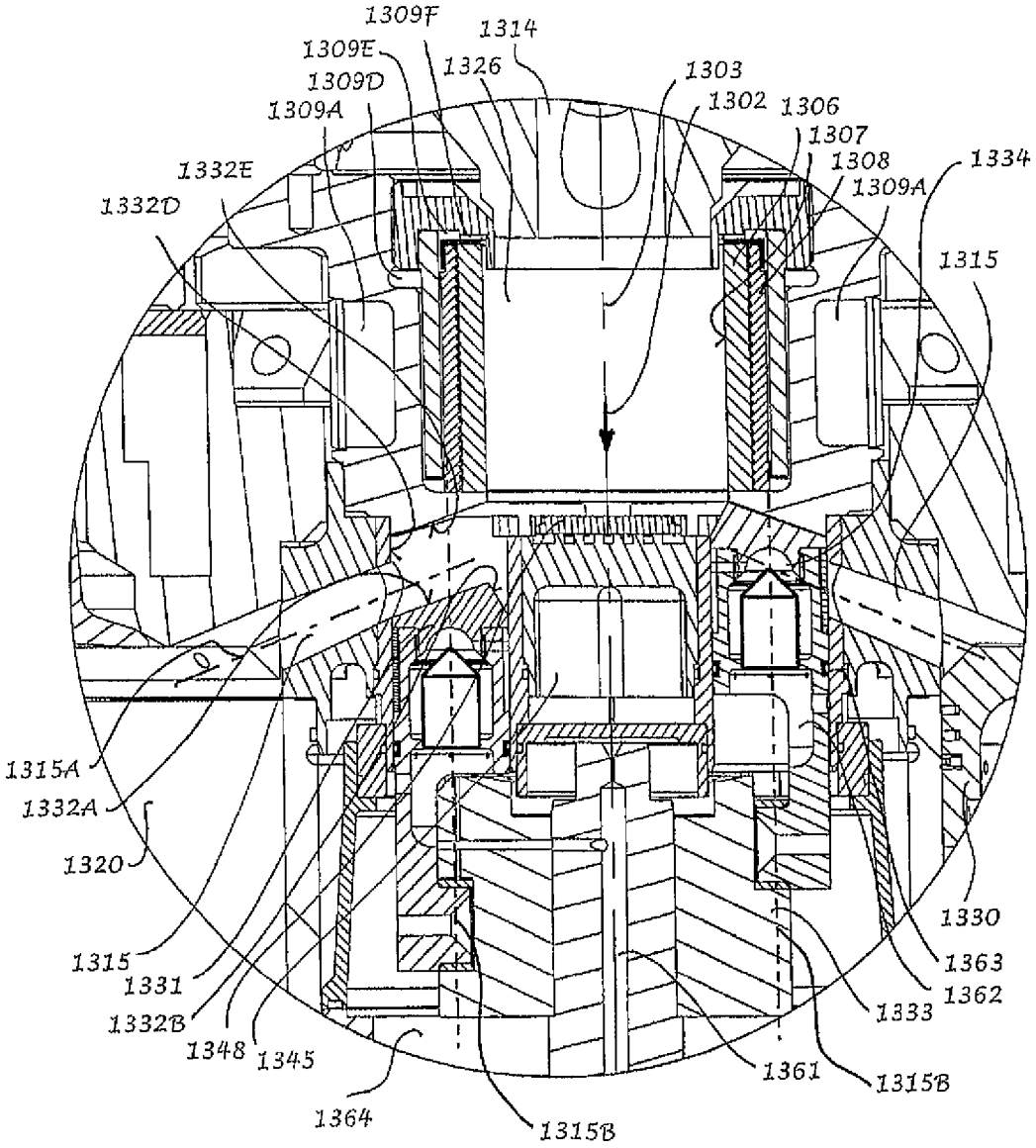
Figure 7:
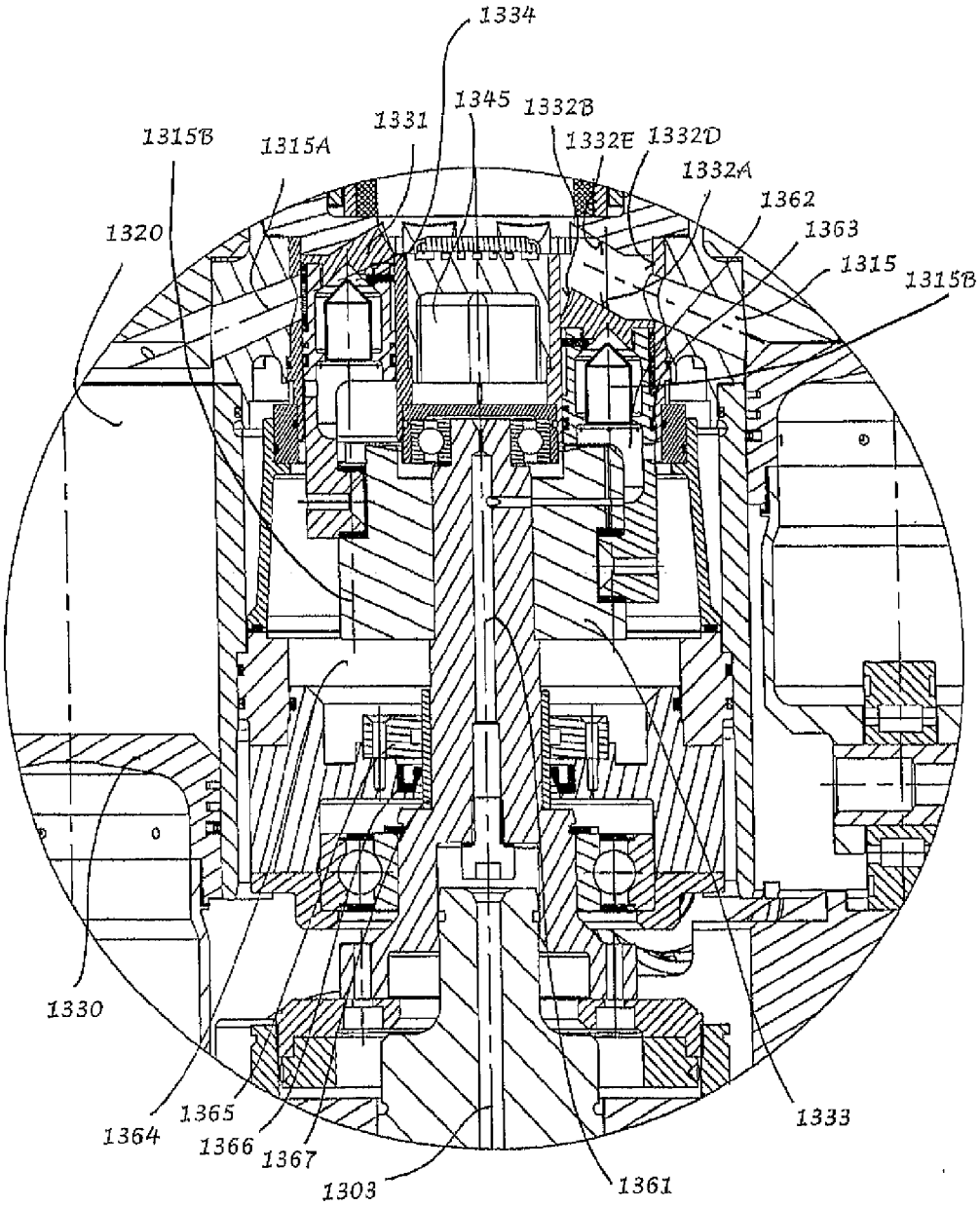
Figure 8:
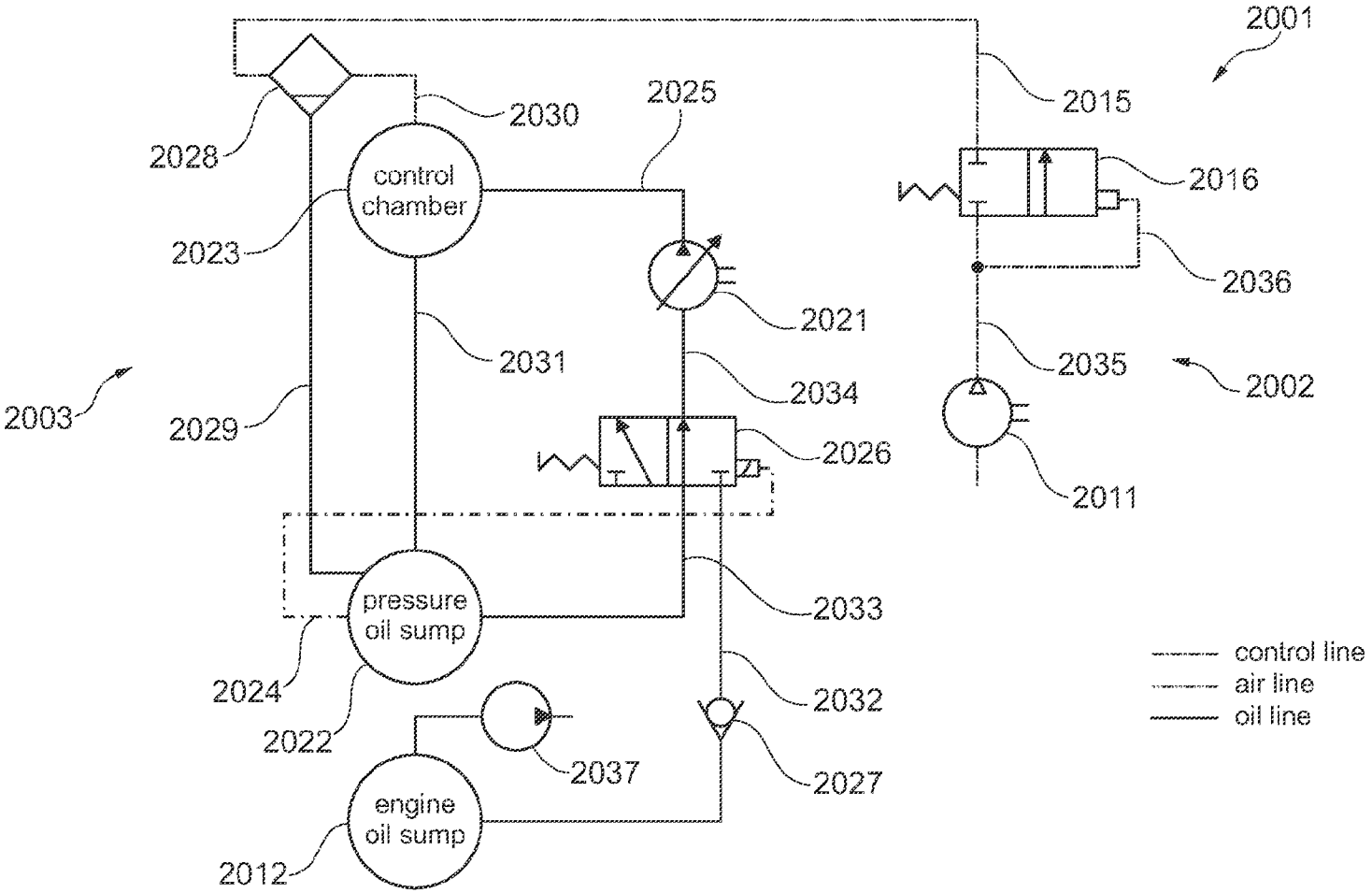
Figure 9:
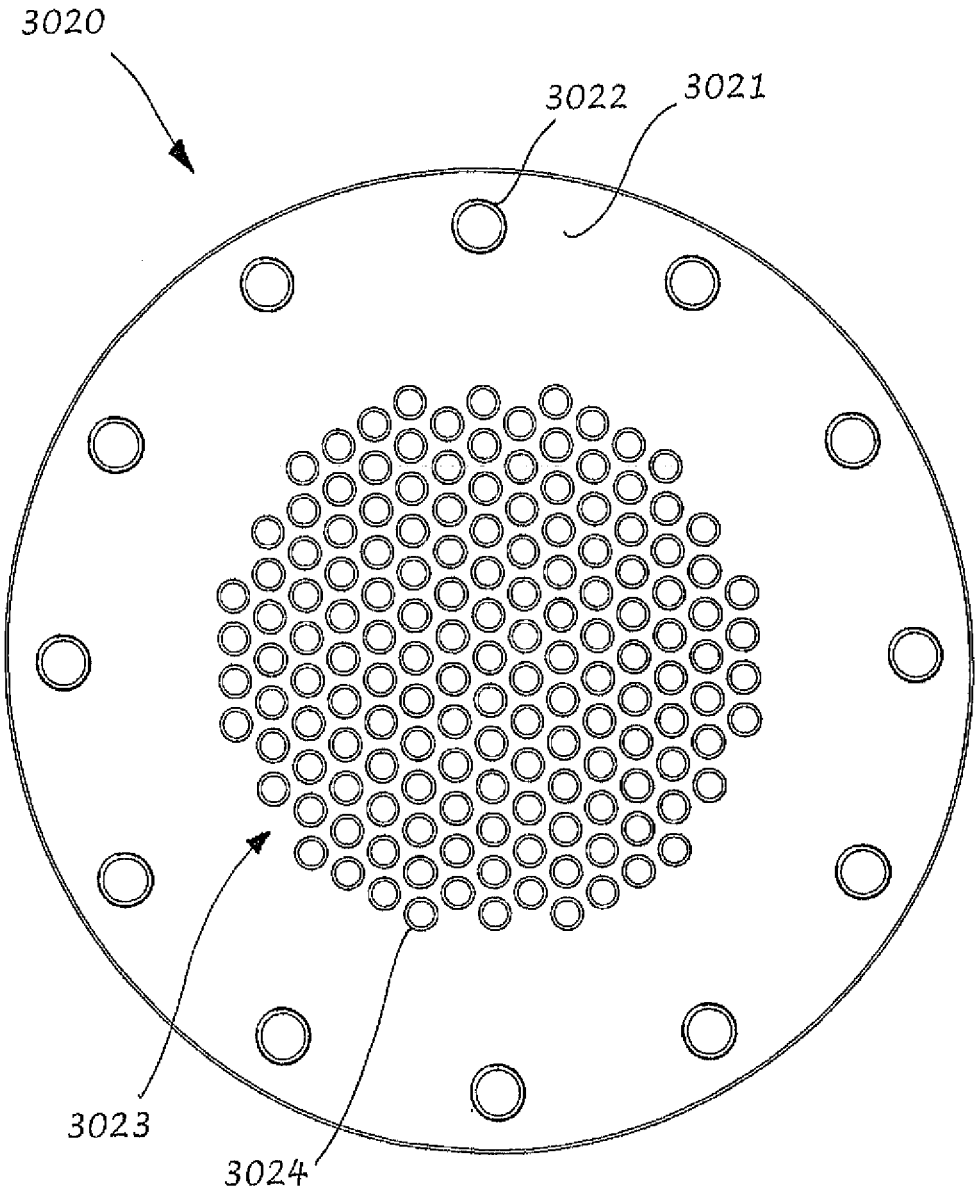
Figure 10:
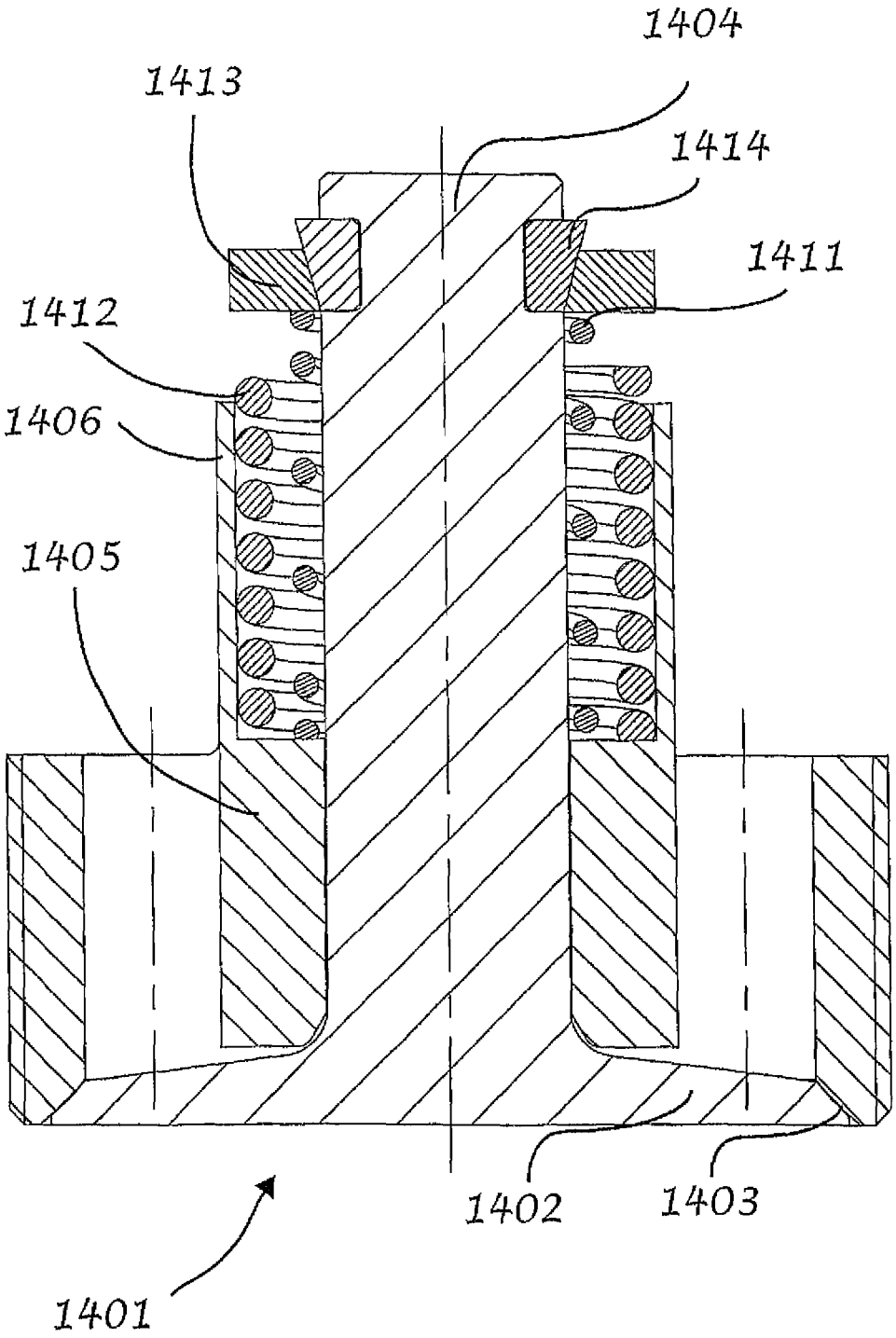
Figure 11:
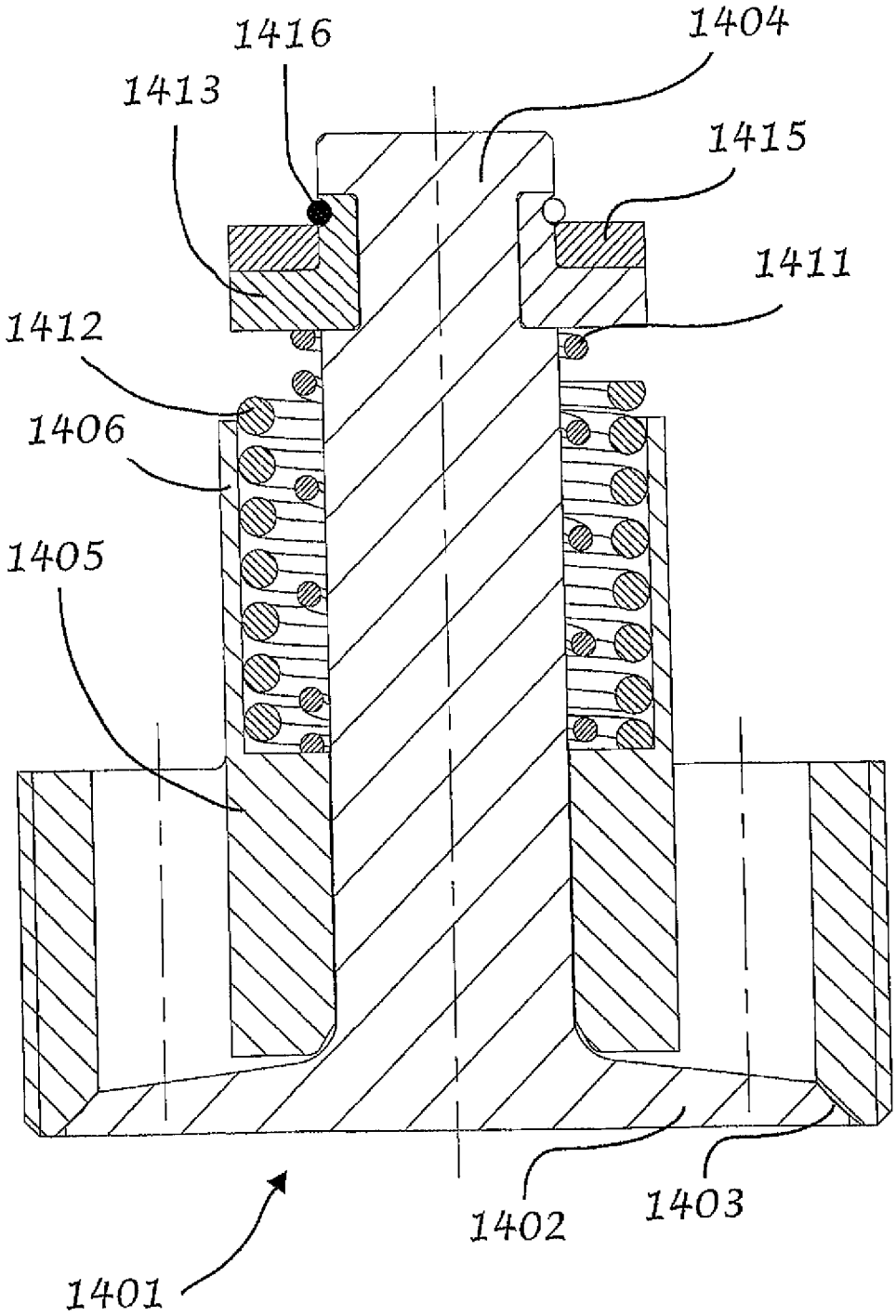

FIG. 1 a schematic sectional view of a first axial-piston engine;

FIG. 2 a schematic top view of the axial-piston engine according to FIG. 1;

FIG. 3 a schematic top view of a second axial-piston engine, in a depiction similar to that in FIG. 2;

FIG. 4 a schematic sectional view of a third axial-piston engine, in a depiction similar to that in FIG. 1;

FIG. 5 a schematic sectional view of a further axial-piston engine with a precombustion temperature sensor and two exhaust gas temperature sensors;

FIG. 6 a schematic sectional view of a further axial-piston engine with a control chamber formed as a pressure space, a cutaway view of the oil circuit and an alternative configuration of the control pistons;

FIG. 7 a schematic sectional view of a further axial-piston engine with a control chamber formed as a pressure space, a cutaway view of the oil circuit and an alternative configuration of the control pistons;

FIG. 8 a schematic view of an oil circuit for an axial-piston engine with a pressure-oil circuit;

FIG. 9 a schematic view of a flange for a heat exchanger, with a matrix situated in it for accommodation of pipes of a heat exchanger;

FIG. 10 a schematic sectional view of a gas exchange valve with a valve spring and an impact spring; and FIG. 11 a further schematic sectional view of a gas exchange valve with a valve spring and an impact spring.

The axial-piston engine 201 depicted in FIGS. 1 and 2 has a continuously working combustion chamber 210, from which working medium is supplied successively via shot channels 215 (numbered as an example) to working cylinders 220 (numbered as an example).

A stream of working medium or a stream of combustion agent inside one of the shot channels 215 from the combustion chamber 210 to the respective working cylinder 220 in this regard is controlled by means of a control piston (not shown explicitly here), which is driven by a control drive (not shown explicitly here).

Advantageously, the control piston, besides the force applied by the control drive, is additionally subjected further to a compensating force directed counter to a combustion chamber pressure, so that the control drive can be designed with particularly simple construction. On the basis of the existing compressor cylinder pressure, the compensating force can be generated pneumatically with particularly little construction complexity.

In particular, sealing at the respective control piston can be undertaken extremely simply when the control piston is situated in a pressure space, in which similar pressure conditions exist as in the combustion chamber 210. In this case, ideally adequate seal tightness is already assured by means of a pure oil-scraping system.

In order to be able to reduce the moving masses advantageously even with respect to the present control piston, the control piston additionally has transverse struts and is made from aluminum, at least with respect to its piston stem. In the region of the piston bottom, however, the control piston consists of an iron alloy on the combustion chamber side, in order that it can better withstand even very high combustion agent temperatures.

Alternatively, the control piston can also be made of a steel alloy, so that it is even more improbable that strength and/or stiffness problems as well as thermal difficulties can occur than with respect to an aluminum alloy.

Situated in each of the working cylinders 220 are working pistons 230 (numbered as an example), which are connected on the one hand by way of a straight connecting rod 235 to an output, which is realized in this exemplary embodiment as a spacer 242 carrying a curved track 240, situated on an output shaft 241, and are connected on the other hand to a compressor piston 250, each of which runs in the compressor cylinder 260 in a manner explained in greater detail below.

The connecting rod 235 has transverse stiffeners (not labeled here), so that it is on the whole of very slender or less massive construction than connecting rods used heretofore in axial-piston engines. By virtue of the transverse stiffeners, a mass reduction undertaken on the connecting rod 235 can be compensated, whereby the connecting rod 235 is not adversely influenced with regard to its stiffness and strength. Furthermore, the connecting rod 235 is made from an aluminum alloy, whereby a further weight reduction is achieved. As is immediately obvious, the connecting rod 235 can be denoted as the drive connecting rod on the drive piston side and as the compressor connecting rod on the compressor side, wherein the working connecting rod and the compressor connecting rod are connected to one another in one piece.

However, not only the connecting rod 235 but also the working piston 230 and the compressor piston 250 are equipped with transverse stiffeners, so that a further substantial weight reduction can be achieved with regard to moving masses of the axial-piston engine 201. In order to be able to counter even higher thermal stresses better, the working pistons 230 each have burning protection of an iron alloy on their cylinder bottoms.

By means of the transversely stiffened connecting rods 235, of the transversely stiffened working pistons 230 and of the transversely stiffened compressor pistons 250, a lightweight construction not yet previously known for conventional axial-piston engines is consequentially implemented in the axial-piston engine 201. All transverse stiffeners are formed in this case as reinforcing struts.

After the working medium has performed its work in working cylinder 220 and has placed a load on working piston 230 accordingly, the working medium is expelled from the working cylinder 220 through exhaust gas channels 225. Provided on the exhaust gas channels 225 are temperature sensors, not shown, which measure the temperature of the exhaust gas.

The exhaust gas channels 225 discharge in each instance into heat exchangers 270, and subsequently leave the axial-piston engine 201 at appropriate outlets 227 in a known manner. The outlets 227 for their part can be connected again in particular to a ring channel, not shown, so that in the end the exhaust gas leaves the engine 201 at only one or two places. Depending on the concrete configuration in particular of the heat exchanger 270, a sound damper can possibly also be dispensed with, since the heat exchangers 270 themselves already have a sound-damping effect.

The heat exchangers 270 serve to preheat combustion agent which is compressed in the compressor cylinders 260 by the compressor pistons 250 and conducted through a pressure line 255 to the combustion chamber 210. The compression takes place in this case in a known manner, by the fact that supply air is drawn in through supply lines 257 (numbered as an example) by the compressor pistons 250 and compressed in the compressor cylinders 260. Known and readily appropriately utilizable valve systems are used to this end.

As immediately obvious from FIG. 2, the axial-piston engine 201 has two heat exchangers 270, each of which is situated axially in reference to the axial-piston engine 201. Through this arrangement, the paths which the exhaust gas must traverse through the exhaust gas channels 225, in each instance to the heat exchangers 270 can be reduced significantly, compared to state-of-the-art axial-piston engines. The result of this is that in the end the exhaust gas reaches the respective heat exchanger 270 at a significantly higher temperature, so that in the end the combustion agent can also be preheated to correspondingly higher temperatures. In practice, it has been found that at least 20% of fuel can be saved through such a configuration. It is assumed in this connection that even savings of up to 30% or more are possible by means of an optimized design.

Furthermore, the heat exchangers are insulated with a thermal insulation of asbestos substitute, not shown here. This ensures that with this exemplary embodiment the external temperature of the axial-piston engine does not exceed 450° C. in the vicinity of the heat exchanger 270 under nearly all operating conditions. The only exceptions are overload situations, which occur only briefly anyway. In this case, the thermal insulation is designed to ensure a temperature gradient of 350° C. at the hottest place of the heat exchanger.

In this connection it is understood that the efficiency of the axial-piston engine 201 can be increased through additional measures. For example, the combustion agent can be used in a known manner to for cooling or thermally insulating the combustion chamber 210, whereby its temperature can be increased still further before it enters the combustion chamber 210. Let it be emphasized here that the corresponding tempering can be limited on the one hand only to components of the combustion agent, as is the case in the present exemplary embodiment in reference to combustion air. It is also conceivable to apply water to the combustion air already before or during the compression; this is also readily possible afterwards, however, for example in the pressure line 255.

Especially preferably, the application of water to the compressor cylinder 260 takes place during an intake stroke of the corresponding compressor piston 250, which results in isothermal compression, or compression as close as possible to isothermal compression. As is directly apparent, each working cycle of the compressor piston 250 comprises an intake stroke and a compression stroke, wherein during the intake stroke combustion agent enters the compressor cylinder 260, which is then compressed, i.e., compressed, during the compression stroke, and conveyed into the pressure line 255. By application of water during the intake stroke, a uniform distribution of the water can be ensured in an operationally simple manner.

It is likewise conceivable to temper the fuel accordingly, wherein this is not absolutely necessary, since the quantity of fuel is usually relatively small in relation to the combustion air, and thus can be brought to high temperatures very quickly.

Likewise the application of water into the pressure line 255 can take place in this configuration, wherein inside the heat exchanger the water is mixed uniformly with the combustion agent by appropriate deflection of the flow. The exhaust gas channel 225 can also be selected for the application of water or another fluid, such as fuel or means for exhaust gas post-treatment, in order to guarantee homogeneous intermixing inside the heat exchanger 270. The configuration of the shown heat exchanger 270 further permits the post-treatment of the exhaust gas in the heat exchanger itself, wherein heat released by the post-treatment is supplied directly to the combustion agent present in the pressure line 255. A water trap, not depicted, which returns the condensed water present in the exhaust gas to the axial-piston engine 201 for renewed application, is situated in the outlet 227. The water trap can of course be designed in connection with a condenser. Furthermore, the use is of course possible in similarly designed axial-piston engines, wherein the other advantageous features on the axial-piston engine 201 or on similar axial-piston engines are advantageous even without use of a water trap in the outlet 227.

The axial-piston engine 301 depicted in FIG. 3 corresponds in its construction and in its manner of functioning essentially to the axial-piston engine 201 according to FIGS. 1 and 2. For this reason we will dispense with a detailed description, wherein assemblies in FIG. 3 that work similarly are also provided with similar reference labels and differ from one another only in the first digit.

The axial-piston engine 301 also has a central combustion chamber 310, from which working medium in the working cylinder 320 can be conducted via shot channels 315 (numbered as an example) according to the working sequence of the axial-piston engine 301. A stream of combustion agent through the shot channels 315 is controlled with appropriate control pistons and control drives, as is described with regard to the axial-piston engine 201.

After the working medium has performed its work, it is fed via exhaust gas channels 325 to heat exchangers 370, in each instance. In this case the axial-piston engine 301, in contrast to the axial-piston engine 201, has one heat exchanger 370 each for exactly two working cylinders 320, whereby the length of the channels 325 can be reduced to a minimum. As is directly apparent, in this exemplary embodiment the heat exchangers 370 are partially inserted into the housing body 305 of the axial-piston engine 301, which leads to an even more compact construction than the construction of the axial-piston engine 201 according to FIGS. 1 and 2. In this case, the measure of how far the heat exchangers 370 can be inserted into the housing body 305 is limited by the possibility of the arrangement of other assemblies, such as, for example, a water cooling system for the working cylinders 220.

The axial-piston engine 401 depicted in FIG. 4 also corresponds essentially to the axial-piston engines 201 and 301 according to FIGS. 1 through 3. Accordingly, identically or similarly working assemblies are also labeled similarly, and differ only in the first digit. Accordingly, in other respects a detailed explanation of the mode of operation will also be dispensed with for this exemplary embodiment, since that was already done in reference to the axial-piston engine 201 according to FIGS. 1 and 2.

The axial-piston engine 401 also includes a housing body 405, on which a continuously working combustion chamber 410, six working cylinders 420 and six compressor cylinders 460 are provided. In this case the combustion chamber 410 is connected via shot channels 415 to the working cylinders 420, in each instance, so that working medium can be fed to the working cylinders 420 corresponding to the timing rate of the axial-piston engine 401.

After its work is done, the working medium leaves the working cylinders 420 through exhaust gas channels 425, which lead to heat exchangers 470, in each instance, wherein these heat exchangers 470 are arranged identically to the heat exchangers 270 of the axial-piston engine 201 according to FIGS. 1 and 2 (see in particular FIG. 2). The working medium leaves the heat exchangers 470 through outlets 427 (numbered as an example).

Situated in the working cylinders 420 and the compressor cylinders 460 are working pistons 430 and compressor pistons 450, respectively, which are connected with one another by means of a rigid connecting rod 435.

The working pistons 430 and the compressor pistons 450 are weight-optimized, therefore encumbered with a smaller mass and for strength reasons accordingly equipped with transverse stiffeners (not shown explicitly here), as is already adequately described with regard to the first axial-piston engine 201 from FIGS. 1 and 2.

For further weight reduction, the pistons 430 and 450 consist of an aluminum alloy. In particular, the working pistons 430 each include burning protection (not labeled explicitly here) of iron on the combustion chamber side, so that they are particularly temperature-resistant. The compressor pistons 450 can also be produced in each instance with such burning protection.

The connecting rod 435 includes in a known manner a curved track 440, which is provided on a spacer 424, which ultimately drives an output shaft 441. Advantageously, the connecting rod 435 is equipped with transverse stiffeners (not shown explicitly here), so that it is also built with less material and is therefore of reduced weight.

In this exemplary embodiment also, combustion air is drawn in through supply lines 457 and compressed in the compressor cylinders 460, in order to be applied via pressure lines 455 to the combustion chamber 410, wherein the measures named in the case of the aforementioned exemplary embodiments can likewise be provided, depending on the concrete implementation.

In addition, in the case of the axial-piston engine 401 the pressure lines 455 are connected with one another via a ring channel 456, whereby a uniform pressure in all pressure lines 455 can be guaranteed in a known manner. Between the ring channel 456 and each of the pressure lines 455 valves 485 are provided, whereby the supply of combustion agent can be regulated or set by the pressure lines 455. Furthermore, a combustion agent reservoir 480 is connected to the ring channel 456 via a reservoir line 481, in which a valve 482 is likewise situated.

The valves 482 and 485 can be opened or closed, depending on the operating state of the axial-piston engine 401. Thus it is conceivable, for example, to close one of the valves 485 when the axial-piston engine 401 needs less combustion agent. It is also conceivable to partially close all valves 485 in such operating situations, and to allow them to operate as throttles. The surplus of combustion agent can then be fed to the combustion agent reservoir 480 when valve 482 is open. The latter is also possible in particular when the axial-piston engine 401 is running under deceleration, i.e., when no combustion agent at all is needed, but rather it is being driven via the output shaft 441. The surplus of combustion agent caused by the movement of the compressor pistons 450 that occurs in such an operating situation can likewise readily be stored in the combustion agent reservoir 480.

The combustion agent stored in this way can be fed supplementally to the axial-piston engine 401 as needed, i.e., in particular in driving off or acceleration situations, as well as for starting, so that a surplus of combustion agent is provided without additional or more rapid movements of the compressor pistons 450.

The valves 482 and 485 can also be dispensed with, if appropriate, to guarantee the latter. Foregoing such valves for prolonged storage of compressed combustion agent seems little suited, due to unavoidable leakage.

In an alternative embodiment to the axial-piston engine 401, the ring channel 456 can be dispensed with, wherein the outlets of the compressor cylinders 460 are then combined corresponding to the number of pressure lines 455—possibly by means of a section of ring channel. With a configuration of this sort it may possibly make sense to connect only one of the pressure lines 455, or not all pressure lines 455 to the combustion agent reservoir 480, or to not provide them as connectible. Such a configuration indeed means that not all compressor pistons 450 can fill the combustion agent reservoir 480 during deceleration. On the other hand, sufficient combustion agent is then available to the combustion chamber 410 so that combustion can be maintained without additional regulation or control system measures. Simultaneously with this, the combustion agent reservoir 480 is filled by means of the other compressor pistons 450, so that combustion agent is stockpiled accordingly and is available immediately, in particular for starting, driving off or acceleration phases.

It is understood that the axial-piston engine 401, in a different alternative embodiment not shown explicitly here, can be equipped with two combustion agent reservoirs 480, wherein the two combustion agent reservoirs 480 can then also be charged with different pressures, so that it is always possible with the two combustion agent reservoirs 480 to work with different pressure intervals in real time. Preferably a pressure regulating system is provided in this case, which sets a first lower pressure limit and a first upper pressure limit for the first combustion agent reservoir 480, and a second lower pressure limit and a second upper pressure limit for the second combustion agent reservoir (not shown here), inside which each combustion agent reservoir 480 is charged with pressures, wherein the first upper pressure limit is below the second upper pressure limit and the first lower pressure limit is below the second lower pressure limit. Specifically, the first upper pressure limit can be set lower than or equal to the second lower pressure limit.

In FIGS. 1 through 4, temperature sensors for measuring the temperature of the exhaust gas or in the combustion chamber are not depicted. For such temperature sensors, all temperature sensors can be considered which can operationally reliably measure temperatures between 800° C. and 1,100° C. In particular, if the combustion chamber comprises a precombustion chamber and a main combustion chamber, the temperature of the precombustion chamber can also be measured by means of such temperature sensors. In this respect, the axial-piston engines 201, 301 and 401 described above can each be regulated by means of the temperature sensors in such a way that the exhaust gas temperature when leaving the working cylinders 220, 320, 420 is approximately 900° C., and the temperature in the precombustion chamber—if present—is approximately 1,000° C.

In the case of the other axial-piston engine 501 shown as an example according to the depiction in FIG. 5, such temperature sensors are present in the form for example of a prechamber temperature sensor 592 and two exhaust gas temperature sensors 593, and are depicted schematically accordingly. In particular by means of the prechamber temperature sensor 592—which in this exemplary embodiment can also be referred to as prechamber temperature sensor 592, due to its proximity to a preburner 517 of the other axial-piston engine 501—a meaningful value concerning the quality of combustion or with regard to the running stability of the other axial-piston engine 501 is ascertained. For example, a flame temperature can be measured in the preburner 517, in order to be able to regulate different operating states in the other axial-piston engine 501 by means of a combustion chamber regulating system. By means of the exhaust gas temperature sensors 593, which are positioned at outlets or exhaust gas channels 525 of the respective working cylinder 520, specifically the operating state of the combustion chamber 510 can be checked cumulatively and regulated if necessary, so that optimal combustion of the combustion agents is always ensured.

Otherwise, the construction and operating principle of the other axial-piston engine 501 correspond to those of the previously described axial-piston engines. In this respect, the other axial-piston engine 501 has a housing body 505, on which a continuously working combustion chamber 510, six working cylinders 520 and six compressor cylinders 560 are provided.

Inside the combustion chamber 510, combustion agent can be both ignited and burned, wherein the combustion chamber 510 can be charged with combustion agent in the manner described above. Advantageously, the other axial-piston engine 501 works with a two-stage combustion system, to which end the combustion chamber 510 has the previously already mentioned preburner 517 and a main burner 518. Combustion agents can be injected into the preburner 517 and into the main burner 518, wherein a proportion of a combustion air of the axial-piston engine 501, which specifically in this exemplary embodiment can be less than 15% of the total combustion air, can be introduced in particular into the preburner 517.

The preburner 517 has a smaller diameter than the main burner 518, wherein the combustion chamber 510 has a transition area that comprises a conical chamber 513 and a cylindrical chamber 514.

To supply combustion agent or combustion air, on the one hand a main nozzle 511 and on the other hand a processing nozzle 512 discharge into the combustion chamber 510, in particular into the associated conical chamber 513. By means of the main nozzle 511 and the processing nozzle 512, combustion agents or combustible substance can be injected into the combustion chambers 510, wherein in this exemplary embodiment the combustion agents injected by means of the processing nozzle 512 are already being mixed or are already mixed with combustion air.

The main nozzle 511 is oriented essentially parallel to a main combustion direction 502 of the combustion chamber 510. Furthermore, the main nozzle 511 is oriented coaxially to an axis of symmetry 503 of the combustion chamber 510, wherein the axis of symmetry 503 lies parallel to the main combustion direction 502.

Furthermore, the processing nozzle 512 is situated at an angle (not sketched explicitly here for the sake of clarity) with respect to the main nozzle 511, so that a jet direction 516 of the main nozzle 511 and a jet direction 519 of the processing nozzle 512 intersect at a mutual point of intersection within the conical chamber 513.

Combustible substance or fuel is injected from the main nozzle 511 into the main burner 518 in this exemplary embodiment without additional air supply, wherein the combustible substance can already be preheated and ideally thermally decomposed by the preburner 517. For precombustion, the volume of combustion air corresponding to the quantity of combustible substance flowing through the main nozzle 511 is introduced into a combustion space 526 behind the preburner 517 or the main burner 518, to which end a separate combustion air supply system 504 is provided, which discharges into the combustion space 526.

To this end, the separate precombustion air supply system 504 is connected to a process air supply system 521, wherein a further combustion air supply system 522 can be supplied with combustion air from the separate combustion air supply system 504, which in this case supplies a perforated ring 523 with combustion air. The perforated ring 523 is assigned in this case to the processing nozzle 512. In this respect, the combustible substance injected with the processing nozzle 512, mixed additionally with process air, can be injected into the preburner 517 or into the conical chamber 513 of the main burner 518.

In addition, the combustion chamber 510, in particular the combustion space 526, includes a ceramic assembly 506, which is advantageously air-cooled. The ceramic assembly 506 includes in this case a ceramic combustion chamber wall 507, which in turn is surrounded by a profiled pipe 508. Around this profiled pipe 508 extends a cooling air chamber 509, which is connected to the process air supply system 521 by means of a cooling air chamber supply system 524.

The known working cylinders 520 carry corresponding working pistons 530, which are mechanically connected to compressor pistons 550 by means of connecting rods 535, in each instance. Both the working pistons 530 and the compressor pistons 550 are of reduced weight and accordingly are formed with less mass than conventional pistons of known axial-combustion engines. However, in order to be able to achieve, furthermore, adequate stiffness and strength values, the pistons 530 and 550 are equipped with transverse stiffeners (not shown explicitly here), which in this exemplary embodiment are also characterized by a component perpendicular to the main extent direction of the respective connecting rod 535. Hereby the pistons 530 and 550 are of extremely robust construction, even though they are extremely light. For further weight reduction, the pistons 530, 550 are designed in aluminum. In order to be able to guarantee high heat resistance nevertheless, the working pistons 530 are reinforced on the respective piston bottom with burning protection (not labeled explicitly here). However, the respective piston stem is formed from aluminum.

Furthermore, the connecting rods 535 are also designed in lightweight construction, wherein they also have transverse stiffeners (not shown), in order to achieve adequate strength and stiffness despite such reduced mass.

In total, the axial-piston engine 501 can already be operated with improved efficiency by virtue of the lightweight construction.

In this exemplary embodiment the connecting rods 535 include connecting rod running wheels 536, which run along a curved track 540, while the working pistons 530 or the compressor pistons 550 are moved. An output shaft 541 is thereby set in rotation, which is connected to the curved track 540 by means of a driving curved track carrier 537. Power generated by the axial-piston engine 501 can be delivered via the output shaft 541.

In a known way, by means of the compressor pistons 550, compression of the process air occurs, also including injected water if appropriate, which if necessary can likewise be utilized for additional cooling. If the application of water or of water vapor occurs during an intake stroke of the corresponding compressor piston 550, isothermal compression of the combustion agent can specifically be promoted. An application of water that accompanies the intake stroke can ensure an especially uniform distribution of the water within the combustion agent, in an operationally simple manner.

Exhaust gases can be cooled significantly more deeply thereby, if necessary, in one or more heat exchangers not depicted here, if the process air is to be prewarmed by means of one or more such heat exchangers and carried to the combustion chamber 510 as combustion agent, as described for example already in detail in the exemplary embodiments already explained above with regard to FIGS. 1 through 4. Corresponding to the axial-piston engine 201, heat exchanger insulating systems can also be provided in the axial-piston engine 501, as otherwise also in the axial-piston engines 301 and 401.

The exhaust gases can be fed to the heat exchanger or heat exchangers via the exhaust gas channels 525 named above, wherein the heat exchangers are arranged axially in reference to the other axial-piston engine 501.

In addition, the process air can be further prewarmed or heated through a contact with additional assemblies of the axial-piston engine 501 that must be cooled, as has also already been explained. The process air compressed and heated in this way is then applied to the combustion chamber 510 in the manner that has already been explained, whereby the efficiency of the other axial-piston engine 501 can be further increased.

Each of the working cylinders 520 of the axial-piston engine 501 is connected via a shot channel 515 to the combustion chamber 510, so that an ignited mixture of combustion agent and combustion air can pass out of the combustion chamber 510 via the shot channels 515 into the respective working cylinder 520 and can perform work on the working pistons 530 as a working medium.

In this respect, the working medium flowing from the combustion chamber 510 can be fed via at least one shot channel 515 successively to at least two working cylinders 520, wherein for each working cylinder 520 one shot channel 515 is provided, which can be closed and opened by means of a control piston 531. Thus the number of the control pistons 531 of the other axial-piston engine 501 is predetermined by the number of the working cylinders 520. Closing or sealing of the shot channel 515 is done in this case by means of the control piston 531, including its control piston cover 532. The control piston 531 is driven by means of a control drive (not labeled explicitly here) with a control piston curved track 533, wherein a spacer 534 for the control piston curved track 533 to the output shaft 541 is provided, which also serves in particular for thermal decoupling. In the present exemplary embodiment of the other axial-piston engine 501, the control piston 531 can perform an essentially axially directed stroke motion 543. To this end, each of the control pistons 531 is guided by means of sliders, not further labeled, which are supported in the control piston curved track 533, wherein the sliders each have a safety cam that runs back and forth in a guideway, not further labeled, and prevents turning in the control piston 531.

In order to improve the sealing at the control piston 531 further on the one hand and to relieve the control drive advantageously on the other hand, not only do the forces applied by the control drive act of the control piston 531 but additionally so also do compensating forces, which are directed counter to the combustion chamber pressure. These compensating forces act on control piston on the side of the control piston facing away from the combustion chamber. In this respect, the compensating forces can advantageously support the sealing with regard to the control piston 531.

To this end, the axial-piston engine 501 is equipped in the region of the control pistons 531 with a pressure space, so that the control pistons 531 work on the combustion chamber side in a corresponding backpressure environment, whereby the sealing is once again achieved more simply. To this end, a corresponding shaft seal can be provided on the bearing, not labeled, which is provided on the combustion chamber side of the output shaft 541 and on the compressor side of the spacer 534.

In order to be able to reduce the moving masses advantageously even with respect to the control piston 531, the control piston 531 also has transverse struts and is made from aluminum, at least with respect to its piston stem. In the region of the piston bottom, however, the control piston 531 consists of an iron alloy, in order that it can better withstand even very high combustion agent temperatures.

Alternatively, the control piston 531 can also be made of a steel alloy, so that strength and/or stiffness problems as well as thermal difficulties can occur to an even lesser extent than with respect to an aluminum alloy.

Since the control piston 531 comes into contact in the area of the shot channel 515 with the hot working medium from the combustion chamber 510, it is advantageous if the control piston 531 is water-cooled. To this end, the other axial-piston engine 501 has a water cooling system 538, in particular in the area of the control piston 531, wherein the water cooling system 538 includes inner cooling channels 545, middle cooling channels 546 and outer cooling channels 547. Well cooled in this way, the control piston 531 can be moved operationally reliably in a corresponding control piston cylinder. Alternatively or cumulatively, an oil cooling system can also be provided.

Furthermore, the surfaces of the control piston 531 in contact with combustion agent are reflective or provided with a reflective coating, so that heat input occurring via heat radiation into the control pistons 531 is minimized. The further surfaces of the shot channels 515 and of the combustion chamber 510 in contact with combustion agent are also provided in this exemplary embodiment (likewise not depicted) with a coating having high spectral reflectivity. This is true in particular for the combustion chamber floor (not numbered explicitly), but also for the ceramic combustion chamber wall 507. It is understood that this configuration of the surfaces in contact with combustion agent can be present in an axial-piston engine even independently of the other configuration features. It is understood that, in modified embodiments, further assemblies can also be reflective or else the aforementioned reflectivenesses can be omitted at least partly.

The shot channels 515 and the control pistons 531 can be provided using especially simple construction, if the other axial-piston engine 501 has a shot channel ring 539. In this case the shot channel ring 539 has a middle axis, around which in particular the parts of the working cylinders 520 and of the control piston cylinders are arranged concentrically. Between each working cylinder 520 and control piston cylinder a shot channel 515 is provided, wherein every shot channel 515 is spatially connected to a cutout (not labeled here) of a combustion chamber floor 548 of the combustion chamber 510. In this respect, the working medium can pass from the combustion chamber 510 via the shot channels 515 into the working cylinders 520 and there perform work, by means of which the compressor pistons 550 can also be moved. It is understood that coatings and inserts can also be provided, depending on the concrete configuration, in order to protect in particular the shot channel ring 539 or its material from direct contact with corrosive combustion products or with excessively high temperatures. The combustion chamber floor 548 in turn can also be provided on its surface with a further ceramic or metallic coating, especially a reflective coating, which on the one hand reduces the heat radiation emerging from the combustion chamber 510 by increasing the reflectivity and on the other hand reduces the heat conduction by reducing the thermal conductivity.

It is understood that the other axial-piston engine 501 can likewise be equipped for example with at least one combustion agent reservoir and corresponding valves, although this is not shown explicitly in the concrete exemplary embodiment according to FIG. 5. In addition, in the case of the other axial-piston engine the combustion agent reservoir can be provided in a double version, in order to be able to store compressed combustion agents at different pressures.

The two existing combustion agent reservoirs can be connected in this case to corresponding pressure lines of the combustion chamber 510, wherein the combustion agent reservoirs are fluid-connectible with or separable from the pressure lines by means of valves. Stop valves or throttle valves, or regulating or control valves, can be provided in particular between the working cylinders 520 or compressor cylinders 560 and the combustion agent reservoir. For example, the aforementioned valves can be opened or closed appropriately during driving-off or acceleration situations, as well as for starting, whereby a surplus of combustion agent can be made available to the combustion chamber 510, at least for a limited period of time.

The combustion agent reservoirs are interconnected fluidically preferably between one of the compressor cylinders and one of the heat exchangers. The two combustion agent reservoirs are ideally operated at different pressures, in order thereby to be able to make very good use of the energy provided by the other axial-piston engine 501 in the form of pressure. To this end, the provided upper pressure limit and lower pressure limit at the first combustion agent reservoir can be set by means of an appropriate pressure regulating system below the upper pressure limits and lower pressure limits of the second combustion agent reservoir. It is understood that in this case work can be done on the combustion agent reservoirs with different pressure intervals.

The further axial-piston engines depicted in FIGS. 6 and 7 correspond substantially to the axial-piston engine 501, so that in this respect a new explanation of the modes of action and operation is not needed. A substantial difference between the axial-piston engines from FIGS. 6 and 7 on the one hand and the axial-piston engine 501 on the other hand is the cooling of the combustion space 1326 charged with combustion agent via the cylindrical chamber 1314, which in the depicted axial-piston engines takes place supplementally via water. It is understood that water cooling of this or similar sort can also be provided in the axial-piston engine 501 or the other axial-piston engines depicted here. To this end, each of the two axial-piston engines has a water chamber 1309A, which surrounds the combustion space 1326 and is fed with liquid water via a supply line. To this end, water with combustion chamber pressure is supplied in each instance via the supply line, not numbered.

This water is applied via branch channels in each instance to a ring channel 1309D, which is in contact with a steel pipe (not numbered), which for its part surrounds the profiled pipe 1308 of the respective combustion space 1326 and is dimensioned such that a ring gap (not numbered) remains in each instance both between the profiled pipe 1308 and the steel pipe on the one hand and also between the steel pipe and the housing part containing the branch channels on the other hand, and such that the two ring gaps are connected with one another via the end of the steel pipe facing away from the ring channel 1309D. It is understood in this case that the pipes can also be made of a material other than steel.

In the depicted axial-piston engines, further ring channels 1309E, which on the one hand are connected with the respective radially inward ring gap and on the other hand open via channels 1309F into a ring nozzle (not numbered), which leads into the respective combustion space 1326, are provided above the profiled pipes 1308. In this case the ring nozzle is aligned axially relative to the combustion chamber wall or to the ceramic combustion chamber wall 1307, so that the water can protect the ceramic combustion chamber wall 1307 even on the combustion chamber side.

It is understood that the water can vaporize in each instance on its way from the supply line to the combustion space 1326 and that the water can be provided if necessary with further additives. It is also understood that if necessary the water can be recovered from the exhaust gas of the respective axial-piston engine and reused.

The axial-piston engine otherwise corresponding substantially to the exemplary embodiments described above includes a combustion space 1326, control pistons 1331, shot channels 1315 and working pistons 1330. The combustion space 1326 situated with rotational symmetry around the axis of symmetry 1303 has, as described above, a ceramic assembly 1306 with a ceramic combustion chamber wall 1307 and a profiled steel pipe 1308. The main combustion direction 1302, in which combustion agent flows in the direction of the shot channels 1315 and working cylinders 1320, extends along the axis of symmetry 1303. The combustion space 1326 is separated from the working cylinder 1320 by the control pistons 1331, situated parallel to the axis of symmetry 1303. Because of the oscillating movement of the control pistons 1331 along their longitudinal axes 1315B, a shot channel 1315 belonging to a control piston is periodically released in each instance, as soon as the working piston 1330 present in the working cylinder 1320 executes a movement in the direction of its top dead point or is already positioned at the top dead point. The shot channel 1315 has the axis of symmetry 1315A, along which a guide face 1332A is aligned. The guide face 1332A aligned parallel to this axis of symmetry 1315A is therefore flush with a wall of the shot channel 1315, as soon as the control piston 1331 is at its bottom dead point, and hereby permits deflection-free flow of the combustion agent in the direction of the working cylinder 1320. In turn, a guide-face sealing face 1332E is aligned parallel to the guide face 1332A, so that this guide-face sealing face 1332E approximately closes upon the guide face 1332A, as soon as the control piston 1331 has reached its top dead point. The cylindrical jacket face of the control piston 1331 further closes upon a stem sealing face 1332D and thus reinforces the sealing action between the combustion space 1326 and the working cylinder 1320. In addition, the control piston 1331 has an impact face 1332B, which is aligned approximately at right angles to the axis of symmetry of the shot channel 1315A. This alignment therefore takes place approximately normal relative to the flow direction of the combustion agent, when this emerges from the combustion space 1326 and enters the shot channel 1315. Consequently, this part of the control piston 1331 is loaded as little as possible by a heat flow, since the impact face 1332B has a minimum surface relative to the combustion space 1326.

The control piston 1331 is controlled via the control piston curved track 1333. This control piston curved track 1333 does not necessarily have a sinusoidally shaped profile. A control piston curved track 1333 deviating from sinusoidal shape makes it possible to hold the control piston 1331 for a specified time interval at the respective top or bottom dead point and hereby, on the one hand, to keep the opening cross section at its maximum possible while the shot channel 1315 is open and, on the other hand, to keep the thermal stress of the control piston surface as a consequence of a critical flow velocity of the combustion agent as low as possible during opening and closing of the shot channel, in that a maximum possible opening speed at the instant of opening is selected via the configuration of the control piston curved track 1333.

FIG. 6 also shows a control piston oil space 1362 present in the control piston 1331, which serves the control piston seal 1363 with oil or receives oil flowing back again from the control piston seal 1363. The control piston oil space 1362 is fed via the pressure-oil circuit 1361. The bottom side of the control piston 1331 points in the direction of the control chamber 1364, formed as the pressure space. At the same time, the control chamber 1364 collects oil emerging from the control piston 1331 and the pressure-oil circuit 1361. It is also possible optionally to charge the inner cooling channels 1345 with oil via the pressure-oil circuit 1361 instead of via a water circuit, in order to cool the bottom side of the combustion space 1326.

In the exemplary embodiment depicted in FIG. 7, a first control chamber seal 1365 and a second control chamber seal 1366 designed as a radial shaft seal ring are provided, which seal the control chamber 1364, which may be at higher pressure, relative to the rest of the axial-piston engine, which is under approximately environmental pressure. The first control chamber seal 1365 and second control chamber seal 1366 seal the control chamber 1364 via a sealing sleeve 1367. This sealing sleeve 1367 is seated by means of a press fit on a rotating central shaft of the axial-piston engine, which partly contains the pressure-oil circuit 1361. Of course the sealing sleeve 1367 can also be connected with the rotating shaft in a different manner. A material connection or an additional seal between the shaft and the sealing sleeve 1367 is also conceivable. As is immediately obvious, these seals are seated on a relatively small radius, so that efficiency losses can be minimized. Likewise these seals are located in a relatively cool region of the axial-piston engine, so that conventional seals can be employed here.

FIG. 7 also shows a further configuration of the control-piston surfaces used for sealing the shot channels 1315. Therein it is evident that the impact face 1332B does not necessarily have to be a planar face, but can also be a segment of a spherical, cylindrical or conical surface and thus, for example have rotationally symmetric shape relative to the axis of symmetry 1303. The guide face 1332A and the guide-face sealing face 1332E can also have shape different from planar. In this case FIG. 7 shows a configuration of the guide face 1332A and of the guide-face sealing face 1332E, wherein these faces represent an angled line, at least in a sectional plane.

The surfaces of the control piston 1331 depicted in this embodiment, such as, for example, the guide face 1332A or the impact face 1332B, as well as the sealing faces, such as the guide-face sealing face 1332E or the stem sealing face 1332D, are also reflective, in order to suppress or minimize heat losses occurring via the control piston due to heat radiation. The applied reflective coating of these surfaces can furthermore also consist of a ceramic coating, which reduces the thermal conductivity or the heat transmission to the control piston. Just as the surfaces of the control piston 1331, the surface of the combustion chamber floor 1348 (shown as an example in FIG. 6) is reflective, in order to minimize heat loss in the wall. For additional cooling, internal cooling channels, which remove heat from the combustion space 1326 optionally with water or oil, are situated on the bottom side of the combustion chamber floor 1348.

The cooling chamber 1334 of the control piston 1331 depicted in FIG. 7 is filled with a metal, sodium in this exemplary embodiment, present in liquid form at operating temperature of the axial-piston engine, which can remove heat from the surfaces of the control piston by convection and heat conduction and discharge it to the oil present in the pressure-oil circuit 1361.

The pressure-oil circuit 1361 supplying the control piston 1331 with oil is schematically depicted in FIG. 8. Therein the interconnection of the engine-oil circuit 2002 with the pressure-oil circuit 2003 and the compressor stage 2011 inside the oil circuit 2001 is depicted. The pressure-oil circuit 2003, which can be closed via the charging valve 2016 and equalizing valve 2026, contains essentially a pressure-oil sump 2022, from which the pressure-oil pumps 2021 can draw oil via the second inflow 2033 and the common inflow 2034 and make it available to the control chamber 2023 via the second supply line 2025. The oil circuit is then closed by the oil return flow 2031, in that the returning oil is supplied back to the pressure-oil sump 2022 via this oil return flow 2031. Provided the pressure-oil circuit 2003 is closed relative to its environment; the pressure-boil pump 2021 needs only minimum power consumption to convey the oil. In this case only the flow losses caused by the circulation of the oil in the pressure-oil circuit 2003 are applied via the pump power The force needed for compensation of a combustion chamber pressure acting on the control piston 1331 is compensated via a pressure applied by the compressor stage 2011. To this end the compressor stage 2011 is likewise connected with the control chamber 2023 via the inflow 2035 and the pressure lines 2015 and 2030. The charging valve 2016 is situated between the inflow 2035 and the pressure line 2015, in order to separate the pressure-oil circuit 2003 from the compressor stage 2011, as soon as no further charging of the pressure-oil circuit 2003 is necessary. In this case the charging valve 2016 is designed as a multi-way valve. The activation of the charging valve 2016 takes place in addition via the control line 2036, which likewise is connected with the compressor stage 2011 via the inflow 2035. The control takes place in one embodiment in such a way that the charging valve 2016 connects the inflow 2035 with the pressure line 2015 when the compressor pressure applied by the compressor stage corresponds to or exceeds the pressure present in the control chamber 2023. A configuration of the charging valve 2016 with a specified opening pressure is also possible. Thus for example, the valve can also be adjusted in such a way that it opens only at a compressor pressure of 30 bar, for example. It is also possible that the charging valve 2016 is activated via performance characteristics resident in the control instrument of the axial-piston engine and thus opens it in dependence on load or speed of revolution. By dependence on load or speed of revolution, the operating state of the axial-piston engine is meant in this case.

In this embodiment, the filling of the pressure-oil circuit 2003 takes place by switching of the equalizing valve 2026, which is connected via the control line 2024 with the pressure-oil sump 2022, so that oil can be supplied from the engine-oil sump 2012 via the first inflow 2032 to the pressure-oil circuit 2003, at least at minimum oil level in the pressure-oil sump 2022, as long as the operating point of the axial-piston engine permits this. The return-flow valve 2027 situated in the first inflow 2032 prevents inadvertent emptying of the pressure-oil circuit 2003 into the engine-oil circuit 2002, unless the pressure-oil pump 2021 can generate a sufficient pressure gradient between the pressure-oil circuit 2003 and the engine-oil circuit 2002.

An oil scraper 2028 is likewise connected between the pressure lines 2015 and 2030. On the one hand this oil scraper 2028 functions to supply the control chamber 2023 with oil-free compressed air, and on the other hand it is obviously also possible that depressurization of the second partial circuit 2003 can take place via the charging valve 2016 and in this way oil-free air is returned to the compressor stage 2011. In the case of a backflow from the pressure-oil circuit 2003 into the compressor stage 2011, the spontaneous ignition of the combustion agent enriched with oil during compression or after compression can therefore be effectively prevented In this case the return flow 2029 connects the oil scraper 2028 with the pressure-oil sump 2022.

The pressure-oil sump 2022 is additionally provided with means for determining an oil level, which are connected via a control line 2024 with the equalizing valve 2026. In this case the equalizing valve 2026 has the task of connecting the engine-oil circuit 2002 with the pressure-oil circuit 2003 or with the engine-oil sump 2012 of the engine-oil circuit 2002. The equalizing valve 2026 therefore further has the task of supplying the pressure-oil circuit 2003 with a sufficiently large amount of oil, in that the pressure-oil pump 2021 can draw deficient oil from the engine-oil sump 2012 via the first inflow 2032. Preferably the connection of the engine-oil circuit 2002 with the pressure-oil circuit 2003 via the equalizing valve 2026 takes place only when the pressure level in the pressure-oil circuit 2003 is particularly low, in order to prevent increased power consumption of the pressure-oil pump 2021 due to a greater pressure difference.

FIG. 9 shows a heat exchanger head plate 3020 which is suitable for use for a heat exchanger for an axial-piston engine. For the purpose of mounting on and connection to an output manifold of an axial-piston engine, the heat exchanger head plate 3020 includes a flange 3021 with corresponding bore holes 3022 arranged in a circle in the radially outer area of the heat exchanger head plate 3020. In the radially inner area of the flange 3021 is the matrix 3023, which has numerous bore holes designed as pipe seats 3024 for accommodation of pipes.

The entire heat exchanger head plate 3020 is preferably made from the same material from which the pipes are also made, in order to ensure that the thermal expansion coefficient is as homogeneous as possible in the entire heat exchanger and that thermal stresses in the heat exchanger are thereby minimized. Cumulatively to this, the jacket housing of the heat exchanger can likewise be produced from a material that corresponds to the heat exchanger head plate 3020 or to the pipes. The pipe seats 3024 can be designed for example with a fit such that the pipes mounted in these pipe seats 3024 are inserted by means of a press fit.

Alternatively to this, the pipe seats 3024 can also be designed so that a clearance fit or a transition fit is realized. In this way, mounting of the pipes in the pipe seats 3024 can also take place by means of a materially bonded connection rather than a frictional connection. The material connection is preferably effected in this case by welding or soldering, wherein a material corresponding to the heat exchanger head plate 3020 or to the pipes is used as the soldering or welding material. This also has the advantage that thermal stresses in the pipe seats 3024 can be minimized by homogeneous thermal expansion coefficients.

It is also possible in the case of this accomplishment to install pipes in the pipe seats 3024 by press fit, and in addition to solder or weld them. Through this type of installation, seal tightness of the heat exchanger can be ensured even if different materials are used for the pipes and the heat exchanger head plate 3020, since the possibility exists that due to the very high occurring temperatures of over 1,000° C. use of only a press fit can fail under certain circumstances because of different thermal expansion coefficients.

FIG. 10 shows a schematic sectional view of a gas-exchange valve 1401 with a valve spring 1411 and an impact spring 1412. In this case the gas-exchange valve 1401 is designed as an automatically opening valve without cam control, which opens at a specified pressure difference, wherein the cylinder internal pressure during an intake process of the cylinder is lower than the pressure in the inlet channel, from which the corresponding cylinder draws a combustion agent. The gas-exchange valve 1401 is preferably used as an inlet valve in the compressor stage. In this case the valve spring 1411 makes a closing force available to the gas-exchange valve 1401, by means of which the opening time can be determined via the configuration of the valve spring 1411. The valve spring 1411, which engages around the valve stem 1404 of the gas-exchange valve 1401, is seated in this case in a valve guide 1405 and is braced against the valve spring plate 1413.

The valve spring plate 1413 in turn is fixed positively on the valve stem 1404 of the gas-exchange valve 1401 with at least two conical pieces 1414.

The configuration of the valve spring 1411, wherein this valve spring 1411 is designed precisely such that opening of the gas-exchange valve 1401 already takes place at small pressure differences, can lead under certain operating conditions to the situation that the gas-exchange valve 1401 experiences such a high acceleration due to the pressure difference present at the valve plate 1402 that it leads to excessive opening of the gas-exchange valve 1401 beyond the defined valve stroke.

Upon opening of the gas-exchange valve 1401, the valve plate 1402 releases, at its valve seat 1403, a flow cross section that from a certain valve stroke on does not substantially increase further. The maximum flow cross section at the valve seat 1403 is usually defined via the diameter of the valve plate 1402. The stroke of the gas-exchange valve 1401 at maximum flow cross section corresponds approximately to one fourth of the diameter of the valve plate 1402 at its inner valve seat. Upon exceedance of the valve stroke or of the computed valve stroke at maximum flow cross section, on the one hand no further substantially increase of the air mass flow occurs at the flow cross section between the valve seat 1403 and the valve plate 1402, and on the other hand it is possible that the valve spring plate 1413 will come into contact with a fixed component of the cylinder head, for example the valve spring guide 1406 in this case, and thus that the valve spring plate 1413 or the valve spring guide 1406 will be destroyed.

In order to prevent or limit this excessive opening of the gas-exchange valve 1401, the valve seat 1403 comes up against the impact spring 1412, whereby the total spring force, consisting of the valve spring 1411 and the impact spring 1412, increases suddenly and the gas-exchange valve 1401 is subjected to strong deceleration. In this exemplary embodiment, the stiffness of the impact spring 1412 is chosen such that, at maximum opening speed of the gas-exchange valve 1401, the gas-exchange valve 1401 is retarded just strongly enough by coming up against the impact spring 1412 that no contact is established between moving components of the valve group, such as, for example, the valve spring plate 1413, and fixed components, such as, for example, the valve spring guide 1406.

The spring force applied in two stages in this embodiment further imparts the advantage that, during the closing process of the gas-exchange valve 1401, this gas-exchange valve 1401 is not accelerated excessively in the opposite direction and does not impact the valve seat 1403 with excessive speed in the valve plate 1402, since the valve spring 1411 responsible for opening and closing the gas-exchange valve 1401 is designed precisely such that it does not supply any excessively high spring forces.

FIG. 11 shows a further schematic sectional view of a gas-exchange valve 1401 with a valve spring 1411 and an impact spring 1412, in which a two-piece valve spring plate 1413 is used in combination with a bracing ring 1415. In this embodiment, the split valve spring plate 1413 is brought into contact with the valve stem 1404 without use of conical pieces 1414, and there it absorbs the spring forces of the valve spring 1411 and of the impact spring 1412 positively. In this case the bracing ring 1415 represents on the one hand a captive safeguard and on the other hand the bracing ring 1415 absorbs forces in radial direction as viewed from the axis of the valve stem. A retaining ring 1416 in turn secures the bracing ring 1415 against falling out.

In order further to achieve smooth opening and closing of the gas-exchange valve, gas-exchange valves 1401 according to this embodiment, i.e., for use in the compressor stage and as an automatically opening valve, are made from a light metal. In this case the lower inertia of a gas-exchange valve 1401 of light metal favors the rapid opening but also the rapid and gentle closing of the gas-exchange valve 1401. Also, the valve seat 1403 is preserved by the low inertia, since the gas-exchange valve 1401 in this embodiment does not release any excessively high kinetic energies during settlement into the valve seat 1403. The gas-exchange valve 1401 shown is preferably made of dural, a high-strength aluminum alloy, whereby the gas-exchange valve 1401 has adequately high strength despite its low density.

| Reference labels: | |
|---|---|
| 201 | axial-piston engine |
| 205 | housing body |
| 210 | combustion chamber |
| 215 | shot channel |
| 220 | working cylinder |
| 225 | exhaust gas channel |
| 227 | outlet |
| 230 | working piston |
| 235 | connecting rod |
| 240 | curved track |
| 241 | output shaft |
| 242 | spacer |
| 250 | compressor piston |
| 255 | pressure line |
| 257 | supply line |
| 260 | compressor cylinder |
| 270 | heat exchanger |
| 301 | axial-piston engine |
| 305 | housing body |
| 310 | combustion chamber |
| 315 | shot channel |
| 320 | working cylinder |
| 325 | exhaust gas channel |
| 370 | heat exchanger |
| 401 | axial-piston engine |
| 405 | housing body |
| 410 | combustion chamber |
| 415 | shot channel |
| 420 | working cylinder |
| 425 | exhaust gas channel |
| 427 | outlet |
| 430 | working piston |
| 435 | connecting rod |
| 440 | curved track |
| 441 | output shaft |

-continued

| Reference labels: | |
|---|---|
| 442 | spacer |
| 450 | compressor piston |
| 455 | pressure line |
| 456 | ring channel |
| 457 | supply line |
| 460 | compressor cylinder |
| 470 | heat exchanger |
| 480 | combustion agent reservoir |
| 481 | reservoir line |
| 485 | valve |
| 501 | axial-piston engine |
| 502 | main combustion direction |
| 503 | axis of symmetry |
| 504 | combustion air supply system |
| 505 | housing body |
| 506 | ceramic assembly |
| 507 | ceramic combustion chamber wall |
| 508 | profiled pipe |
| 509 | cooling air chamber |
| 510 | combustion chamber |
| 511 | main nozzle |
| 512 | processing nozzle |
| 513 | conical chamber |
| 514 | cylindrical chamber |
| 515 | shot channel |
| 516 | first jet direction |
| 517 | preburner |
| 518 | main burner |
| 519 | further jet direction |
| 520 | working cylinder |
| 521 | process air supply system |
| 522 | further combustion air supply system |
| 523 | perforated ring |
| 524 | cooling air chamber supply system |
| 525 | exhaust gas channel |
| 526 | combustion space |
| 530 | working piston |
| 531 | control piston |
| 532 | control piston cover |
| 533 | control piston curved track |
| 534 | spacer |
| 535 | connecting rod |
| 536 | connecting rod running wheels |
| 537 | driving curved track carrier |
| 538 | water cooling system |
| 539 | shot channel ring |
| 540 | curved track |
| 541 | output shaft |
| 543 | stroke motion |
| 545 | inner cooling channels |
| 546 | middle cooling channels |
| 547 | outer cooling channels |
| 548 | combustion chamber floor |
| 550 | compressor piston |
| 560 | compressor cylinder |
| 592 | prechamber temperature sensor |
| 593 | exhaust gas temperature sensor |
| 1302 | main combustion direction |
| 1303 | axis of symmetry |
| 1306 | ceramic assembly |
| 1307 | ceramic combustion chamber wall |
| 1308 | profiled steel pipe |
| 1309A | water chamber |
| 1309D | ring channel |
| 1309E | ring channel |
| 1309F | channel |
| 1314 | cylindrical chamber |
| 1315 | shot channel |
| 1315A | axis of symmetry of the shot channel |
| 1315B | longitudinal axis of the control piston |
| 1320 | working cylinder |
| 1326 | combustion space |
| 1330 | working piston |
| 1331 | control piston |
| 1332A | guide face |
| 1332B | impact face |
| 1332D | stem sealing face |

-continued

| Reference labels: | |
|---|---|
| 1332E | guide-face sealing face |
| 1333 | control piston curved track |
| 1334 | cooling chamber |
| 1345 | inner cooling channels |
| 1348 | combustion chamber floor |
| 1361 | pressure-oil circuit |
| 1362 | control piston oil space |
| 1363 | control piston seal |
| 1364 | control chamber |
| 1365 | first control chamber seal |
| 1366 | second control chamber seal |
| 1367 | sealing sleeve |
| 1401 | gas exchange valve |
| 1402 | valve plate |
| 1403 | valve seat |
| 1404 | valve stem |
| 1405 | valve guide |
| 1406 | valve spring guide |
| 1411 | valve spring |
| 1412 | impact spring |
| 1413 | valve spring plate |
| 1414 | conical piece |
| 1415 | bracing ring |
| 1416 | retaining ring |
| 2001 | oil circuit |
| 2002 | engine-oil circuit |
| 2003 | pressure-oil circuit |
| 2011 | compressor stage |
| 2012 | engine-oil sump |
| 2015 | pressure line |
| 2016 | charging valve |
| 2021 | pressure-oil pump |
| 2022 | pressure-oil sump |
| 2023 | control chamber |
| 2024 | oil level control line |
| 2025 | second supply line |
| 2026 | equalizing valve |
| 2027 | return-flow valve |
| 2028 | oil scraper |
| 2029 | return flow |
| 2030 | pressure line |
| 2031 | oil return flow |
| 2032 | first inflow |
| 2033 | second inflow |
| 2034 | common inflow |
| 2035 | inflow |
| 2036 | control line |
| 2037 | engine-oil-pump |
| 3020 | heat exchanger head plate |
| 3021 | flange |
| 3022 | mounting hole |
| 3023 | matrix |
| 3024 | pipe seat |

The invention claimed is:

1. Axial-piston engine with a compressor stage comprising at least one cylinder, with an expander stage comprising at least one cylinder, with at least one combustion chamber between the compressor stage and the expander stage, with at least one component subjected to combustion chamber pressure and with an oil circuit for lubrication, wherein the oil circuit has an engine-oil circuit and a pressure-oil circuit with a pressure level different from the engine-oil circuit; and wherein at least one control chamber is a component of the pressure-oil circuit.

2. Axial-piston engine according to claim 1, wherein the pressure level of the pressure-oil circuit corresponds to the combustion chamber pressure.

3. Axial-piston engine according to claim 1, wherein the pressure level of the pressure-oil circuit corresponds to a compressor pressure.

4. Axial-piston engine according to claim 1, wherein the pressure-oil circuit has a pressure level between 5 bar and 20 bar during a partial load of the axial-piston engine.

5. Axial-piston engine according to claim 1, wherein the pressure-oil has a pressure level below 5 bar during idling of the axial-piston engine and/or during standstill of the axial-piston engine.

6. Axial-piston engine according to claim 1, wherein the engine-oil circuit has an engine-oil sump and an engine-oil pump and the pressure-oil circuit has a pressure-oil sump and a pressure-oil pump.

7. Axial-piston engine according to claim 1, wherein the pressure-oil circuit is connected via a charging line with at least one cylinder of the compressor stage.

8. Axial-piston engine according to claim 1, wherein a charging valve is situated between at least one cylinder of the compressor stage and the pressure-oil circuit.

9. Axial-piston engine according to claim 8, wherein the charging valve is operatively connected with the compressor stage and has a corresponding control device with means for switching.

10. Axial-piston engine according to claim 8, wherein the charging valve switches at a charging pressure of 5 bar, preferably at 10 bar, most preferably at 30 bar.

11. Axial-piston engine according to claim 8, wherein the charging valve is a check valve.

12. Axial-piston engine according to claim 1, wherein an equalizing valve is situated between the pressure-oil sump and the pressure-oil pump as well as between the engine-oil sump and the pressure-oil pump.

13. Axial-piston engine according to claim 12, wherein the equalizing valve, in a first operating state, connects the pressure-oil sump with the pressure-oil pump and, in a second operating state, connects the engine-oil sump or the engine-oil pump with the pressure-oil pump.

14. Method for operation of an axial-piston engine with a compressor stage comprising at least one cylinder, with an expander stage comprising at least one cylinder and with at least one combustion chamber between the compressor stage and the expander stage, wherein a stream of combustion agent, under combustion chamber pressure, from the combustion chamber to the cylinder of the expander stage is controlled via at least one control piston and the axial-piston engine has an oil circuit for lubrication, wherein the oil circuit is split into an engine-oil circuit and into a pressure-oil circuit and components of the axial-piston engine subjected to combustion chamber pressure are lubricated by the pressure-oil circuit; and wherein the combustion chamber pressure acting on the control piston is compensated by a pressure level present in a control chamber and corresponding to the combustion chamber pressure.

15. Method for operation of an axial-piston engine according to claim 14, wherein the pressure level in the control chamber corresponding to the combustion chamber pressure is supplied by the compressor stage.

16. Method for operation of an axial-piston engine according to claim 14, wherein in the case of a drop below a minimum oil level in a pressure-oil sump, the pressure-oil circuit is filled with oil from the engine-oil circuit.

17. Method for operation of an axial-piston engine according to claim 14, wherein the pressure-oil circuit is connected with the engine-oil circuit during idling and/or during standstill of the axial-piston engine.

18. Method for operation of an axial-piston engine according to claim 14, wherein the pressure-oil circuit is connected with the engine-oil circuit at a pressure difference smaller than 5 bar between the pressure-oil circuit and the engine-oil circuit.

* * * * *